US011478082B2

(12) United States Patent
Gervais

(10) Patent No.: US 11,478,082 B2
(45) Date of Patent: Oct. 25, 2022

(54) CARE CHAIR

(71) Applicant: Barbara Gervais, Shoreview, MN (US)

(72) Inventor: Barbara Gervais, Shoreview, MN (US)

( * ) Notice: Subject to any disclaimer, the term of this patent is extended or adjusted under 35 U.S.C. 154(b) by 0 days.

(21) Appl. No.: 17/559,819

(22) Filed: Dec. 22, 2021

(65) Prior Publication Data

US 2022/0192381 A1 Jun. 23, 2022

Related U.S. Application Data

(60) Provisional application No. 63/129,342, filed on Dec. 22, 2020.

(51) Int. Cl.

| | |
|---|---|
| ***A61G 5/14*** | (2006.01) |
| ***A47C 1/032*** | (2006.01) |
| ***A47C 1/022*** | (2006.01) |
| ***A61H 1/02*** | (2006.01) |
| ***A47B 91/02*** | (2006.01) |

(52) U.S. Cl.

CPC ..... *A47C 1/03261* (2013.01); *A47B 91/024* (2013.01); *A47C 1/022* (2013.01); *A61H 1/02* (2013.01); *A61H 2201/1657* (2013.01)

(58) Field of Classification Search

CPC ..... A61G 5/14
USPC ..... 297/330, DIG. 10
See application file for complete search history.

(56) References Cited

U.S. PATENT DOCUMENTS 2,850,075 A * 9/1958 Wilson ..... A61G 5/1059 297/DIG. 10
3,592,423 A 7/1971 Mui
3,596,991 A * 8/1971 Mckee ..... A61G 5/14 297/DIG. 10
3,640,566 A * 2/1972 Hodge ..... A61G 5/006 297/DIG. 10 X
3,641,620 A 2/1972 Hage
3,964,786 A * 6/1976 Mashuda ..... A61G 5/006 297/DIG. 10
4,407,543 A * 10/1983 Mashuda ..... A61G 5/006 297/DIG. 10
4,860,733 A 8/1989 Parker, Jr.
4,921,247 A 5/1990 Sterling
5,022,708 A * 6/1991 Nordella ..... G09B 9/14 248/398
5,096,008 A * 3/1992 Mankowski ..... A61G 5/042 297/DIG. 10
5,346,280 A * 9/1994 Deumite ..... A61G 5/14 297/DIG. 10
5,437,609 A 8/1995 Leonard et al.
5,470,298 A 11/1995 Curtis
5,803,545 A * 9/1998 Guguin ..... A61G 5/14 297/DIG. 10

(Continued)

FOREIGN PATENT DOCUMENTS

FR 2513499 A1 * 4/1983 ..... A61G 5/14

*Primary Examiner* — Rodney B White

(74) *Attorney, Agent, or Firm* — Dykema Gossett PLLC

(57) ABSTRACT

Various aspects of the present disclosure are directed to adjustable chairs with a plurality of adjustment points to facilitate enhanced user mobility and increase a user's physical activity through guided exercises and stretches. In one example embodiment, a chair is disclosed including a lifting mechanism to assist a user from a seating to a standing position and facilitates standing stretches through a number of motion and rotation mechanisms.

22 Claims, 17 Drawing Sheets

(56) References Cited

U.S. PATENT DOCUMENTS 5,806,920 A * 9/1998 Blount ..... A61G 5/14 297/DIG. 10
5,988,574 A 11/1999 Podgorski et al.
5,992,931 A 11/1999 LaPointe et al.
6,154,690 A * 11/2000 Coleman ..... A61G 5/14 280/250.1 X
6,336,235 B1 1/2002 Ruehl
6,349,907 B1 2/2002 Hollington et al.
6,533,353 B2 * 3/2003 Johnston ..... A61G 5/125 297/DIG. 10
6,855,098 B2 2/2005 Reitz et al.
6,979,284 B2 12/2005 Curtis
7,094,188 B2 8/2006 Reitz et al.
7,147,278 B2 12/2006 Johnson et al.
7,276,018 B2 10/2007 Studdard
7,287,732 B2 10/2007 Balistreri
7,413,245 B2 8/2008 Johnson et al.
7,419,216 B2 * 9/2008 Hunziker ..... A61G 5/125 297/411.39
7,484,700 B2 2/2009 Selle
7,537,553 B2 5/2009 Mongelluzzo et al.
7,549,705 B2 6/2009 Man et al.
7,556,227 B2 7/2009 Thuelig
7,600,817 B2 10/2009 Kramer et al.
7,640,090 B2 * 12/2009 Uchida ..... B60N 2/888 297/216.12
7,762,158 B2 7/2010 Shieh et al.
7,946,672 B2 5/2011 Saikawa
8,104,835 B2 * 1/2012 Ovre ..... A61G 5/127 297/DIG. 10
8,205,843 B2 6/2012 Phillips et al.
8,220,770 B2 7/2012 Justis
8,262,038 B1 9/2012 Hallet
8,302,221 B1 * 11/2012 Camp, Jr. ..... A61G 5/14 5/81.1 RP
8,403,352 B2 3/2013 Hunziker
8,641,588 B2 2/2014 Verheem
8,783,770 B2 7/2014 Tanaka et al.
8,795,141 B2 8/2014 Huang
8,905,906 B2 12/2014 Man et al.
8,944,977 B2 2/2015 Foster et al.
9,045,058 B2 * 6/2015 Katoh ..... B60N 2/80
9,078,796 B1 * 7/2015 Hall ..... A47C 3/22
9,220,939 B2 12/2015 Chen
9,233,271 B2 1/2016 Chen
9,301,895 B2 4/2016 Hough et al.
9,351,890 B2 5/2016 Hough et al.
9,427,371 B1 8/2016 Lamar
9,446,286 B2 9/2016 Wang
9,492,339 B2 11/2016 Leib
9,629,765 B1 * 4/2017 Mitchell ..... A61G 5/1075
9,682,682 B2 * 6/2017 Aoki ..... B60R 22/26
9,713,559 B2 7/2017 Hough et al.
9,795,528 B1 * 10/2017 Delmestri ..... A61G 5/104
9,854,912 B2 1/2018 Iacobucci
9,975,458 B2 * 5/2018 Takeuchi ..... B60N 2/39
10,021,979 B2 7/2018 Miller
10,143,607 B2 12/2018 Ravn
10,272,282 B2 4/2019 Harlow
10,507,146 B1 12/2019 Alhajery et al.
10,537,181 B2 1/2020 Brodbeck
10,667,612 B2 6/2020 Matlin et al.
10,888,476 B2 1/2021 Fakhrizadeh
10,960,255 B2 3/2021 Bourke et al.
11,077,002 B1 * 8/2021 Crump ..... A61G 5/14
2001/0050500 A1 12/2001 Piretti
2003/0073552 A1 4/2003 Knight
2003/0227161 A1 * 12/2003 Redman ..... A61G 5/045 280/755
2004/0212177 A1 * 10/2004 Kuiken ..... A61G 5/14 280/647
2006/0103209 A1 * 5/2006 Olcheski ..... A61G 5/14 297/330
2006/0116259 A1 6/2006 Smith
2007/0085396 A1 * 4/2007 Hunziker ..... A61G 5/1067 297/330 X
2007/0246986 A1 * 10/2007 White ..... A47C 1/029 297/344.1
2008/0146422 A1 6/2008 Bae
2008/0168855 A1 7/2008 Giefer et al.
2009/0105046 A1 4/2009 Rudlich
2009/0108648 A1 4/2009 Biggs et al.
2009/0233773 A1 9/2009 Cardey
2010/0117427 A1 5/2010 Fukuyama et al.
2011/0140484 A1 6/2011 Chang
2013/0119733 A1 * 5/2013 White ..... A61G 5/14 297/284.1
2014/0138995 A1 * 5/2014 Leib ..... A61H 3/008 297/283.2
2015/0060162 A1 * 3/2015 Goffer ..... B60L 15/20 180/41
2015/0084307 A1 * 3/2015 Goldish ..... A61G 5/1089 280/250
2015/0209207 A1 * 7/2015 Cooper ..... A61G 5/128 701/49
2015/0257950 A1 * 9/2015 Ten Holter ..... A61G 5/1072 297/316
2015/0283009 A1 * 10/2015 Borisoff ..... A61G 5/14 280/47.41
2016/0045382 A1 * 2/2016 Goffer ..... B60L 50/51 280/657
2016/0058191 A1 * 3/2016 Hegedus ..... A47C 1/0342 297/330 X
2016/0206099 A1 * 7/2016 Robertson ..... A47C 1/03294
2016/0346143 A1 * 12/2016 White ..... A47C 1/029
2017/0056262 A1 * 3/2017 Yamada ..... A61G 5/14
2017/0224112 A1 8/2017 DeVereux
2018/0001729 A1 * 1/2018 Goffer ..... B60G 17/01908
2018/0042798 A1 * 2/2018 Davies ..... A47C 1/035
2018/0055703 A1 * 3/2018 Ortiz ..... A47C 7/74
2018/0221226 A1 * 8/2018 Moore ..... A61H 1/024
2018/0369049 A1 * 12/2018 Eskridge, III ..... A61G 7/16
2019/0053970 A1 * 2/2019 Vatti ..... A61G 7/1003
2020/0046128 A1 2/2020 Sramek
2020/0229998 A1 * 7/2020 Paz ..... G16H 20/30
2020/0246207 A1 * 8/2020 Williams ..... A61G 5/1051
2021/0244585 A1 * 8/2021 Ohta ..... A61G 5/1048

* cited by examiner

CARE CHAIR

CROSS-REFERENCE TO RELATED APPLICATIONS

This application claims the benefit of U.S. provisional application No. 63/129,342, filed 22 Dec. 2020, which is hereby incorporated by reference as though fully set forth herein.

BACKGROUND a. Field

The instant disclosure relates to chairs; more specifically, to chairs for home healthcare and healthcare applications (among others).

b. Background Art

This invention generally relates to lift chairs and, more particularly, to reclinable lift chairs often used to assist in the care of invalids, elderly, disabled and/or persons recovering from injuries. Persons with a number of medical conditions often find the movement required to arise from a seated position particularly difficult. Persons who require lift chairs to assist in movement between a sitting and standing position are also often physically incapable of exercising and stretching without assistance. A persistent lack of stretching and exercise over time may further their physical degradation and reliance on aids such as lift chairs, walkers, wheelchairs, etc.

The foregoing discussion is intended only to illustrate the present field and should not be taken as a disavowal of claim scope.

BRIEF SUMMARY

The instant disclosure relates to adjustable chairs with a plurality of adjustment points to facilitate enhanced user mobility and increase a user's physical activity through guided exercises.

In one example embodiment, an adjustable chair is disclosed including a backrest including a back support structure, a seat including a seat support structure, a base including a base mount, a lifting mechanism and a reclining mechanism. The lifting mechanism couples the base mount and the seat support structure, and adjusts a pitch of the seat support structure. The reclining mechanism couples the seat support structure and the back support structure, and adjusts an attitude of the back support structure relative to the seat support structure.

In some more specific embodiments, an adjustable chair consistent with the present disclosure may include a backrest including a back support structure, a seat including a seat support structure, a base including a base mount; a lifting mechanism, a reclining mechanism, a yaw mechanism, a backrest mount and a roll mechanism. The lifting mechanism couples the base mount and the seat support structure, and adjusts a pitch of the seat support structure. The reclining mechanism couples the seat support structure and the back support structure, and adjusts an attitude of the back support structure relative to the seat support structure. The yaw mechanism is coupled between the base mount and the seat support structure, and adjusts a yaw of the backrest relative to the seat. The backrest mount is coupled to the back support structure via the roll mechanism, and the roll mechanism may roll the backrest mount relative to the back support structure.

Some aspects of the present disclosure are directed to methods of operating an adjustable chair. In one example embodiment, the method includes receiving a user input indicative of a desired assisted exercise and/or stretch, and activating one or more of a plurality of mechanisms within the adjustable chair to facilitate the assisted exercise and/or stretch of the user.

The foregoing and other aspects, features, details, utilities, and advantages of the present disclosure will be apparent from reading the following description and claims, and from reviewing the accompanying drawings.

BRIEF DESCRIPTION OF THE DRAWINGS

Various example embodiments may be more completely understood in consideration of the following detailed description in connection with the accompanying drawings, in which.

DETAILED DESCRIPTION OF EMBODIMENTS

Figure 1A:
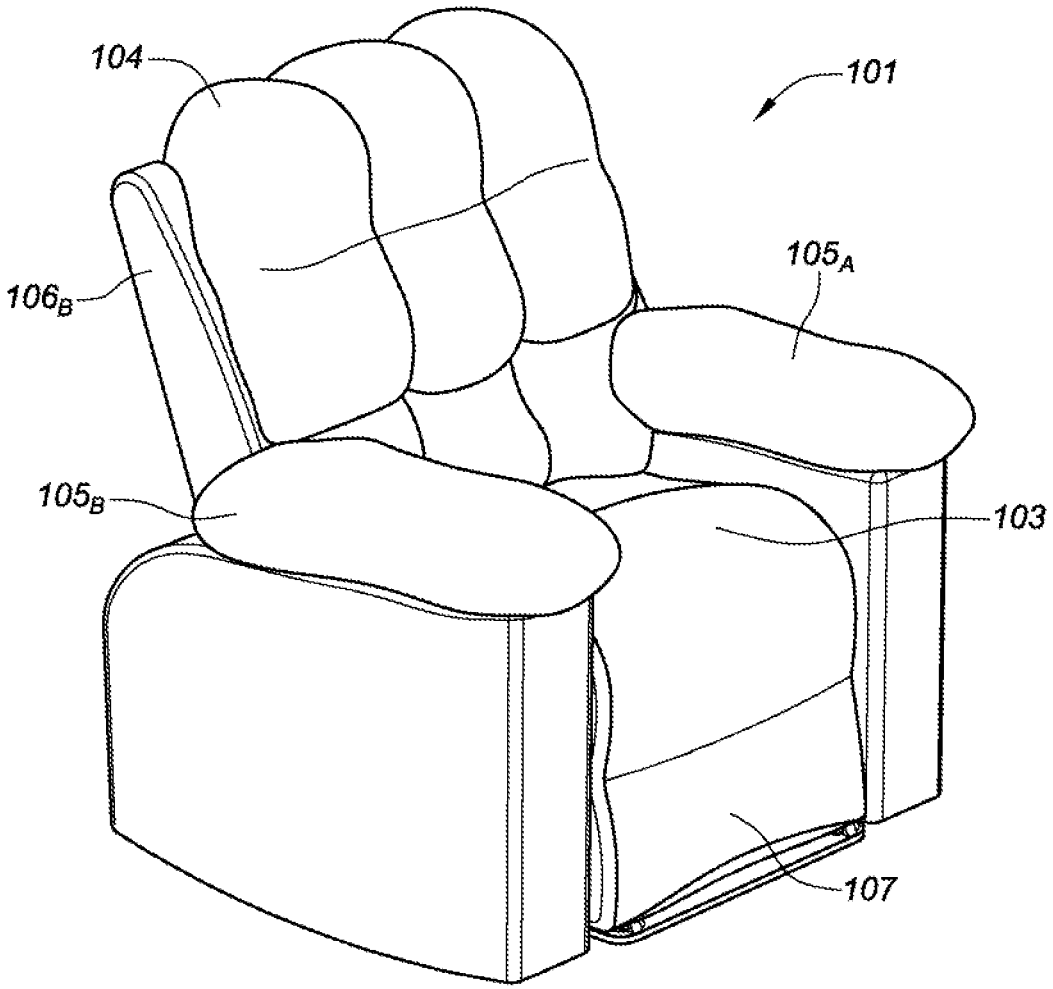
FIG. 1A is a right side isometric view of a chair, consistent with various embodiments of the present disclosure.

The instant disclosure relates to adjustable chairs with a plurality of motion and rotation mechanisms to facilitate enhanced user mobility and increase a user's physical activity through guided exercises and stretching. For example, a chair consistent with the present disclosure may include a lifting mechanism to assist a user from a seating to a standing position and facilitates standing stretches through the motion and rotation mechanisms of the chair limiting the need for direct caretaker intervention (during such stretches/exercises).

Often times people with and without physical limitations are unable to safely reach their physical fitness needs and goals, especially where their exercise requires intervention by a third-party for safety (e.g., to prevent a fall, or other injury). Additionally, the third-party may be a medical professional with limited availability (further limiting one's ability to regularly exercise). One particular benefit of a chair consistent with the present disclosure is the ability for a user with decreased mobility, for example, to safely stretch and exercise in conjunction with the chair without the need for direct caretaker involvement and greatly reduced risk of falls and other injuries.

Chairs consistent with the present disclosure have a myriad of applications and functionality, as will be clear in view of the drawings and detailed description herein. A few example features and functions are: back-rest (semi-)reclines, leg extension/raise, exercise from sitting and/or standing position, lift chair (sit to stand), facilitate physical exercise of many of the muscle groups of a user, physical therapy movements, mobility enhancement, muscle toning, upper core movements, lower extremity motion, leg raises, arm movements, leg movements, core movements and rotation, shoulder movements, supine flat user positioning, Trendelenburg (head lower) user positioning, full stand, partial stand, side-bending range of motion, up-down bending movements, among many others that will be clear to a skilled artisan in view of Applicant's disclosure herein.

Those having one or more of the following conditions, ailments, situations (among others) may benefit from the chair disclosed herein, including: Parkinson Disease, stroke patient, heart attack patient, Muscular Dystrophy, fatigue, obesity, the elderly, postpartum mothers, chronic migraine sufferers, brain injury, transitional care candidates, car accident patients, pain management, various chronic conditions, pre-surgery, post-surgical, sports-related injuries, genetic disorders, musculoskeletal disorders, work-related injuries, fall risk users; balance compromised users (e.g., dizziness, Vertigo), circulatory system conditions, neurological disorders, limited mobility, paralysis patients, Lymphedema, physical therapy patients, spinal injuries, high blood pressure, Diabetes, Dementia, Edema, Lymphatic system conditions, Multiple Sclerosis, mobility limited (e.g., chair confined users and those bedridden), joint(s) replacement(s) patients, muscle weakness, physical rehabilitation, range of motion, strength building/maintenance, among other various conditions, ailments, applications that will be readily apparent to a skilled artisan in view of Applicant's disclosure herein.

Applications for chairs disclosed herein may include, for example: at home use, nursery, nursing home, transitional care, hospice care, medical facilities, medical clinics, physical therapy/rehabilitation clinics, and fitness facilities.

Chairs consistent with the present disclosure facilitate user exercises and stretches including, for example: reach and grasp, upper core movements, lower extremity movements, neck movements, arm extensions, sit-to-stand, leg lifts, lunge, standing hip abduction, weight shift(s), (mini) squats (one or both legs), sitting trunk rotations, various balance exercises (e.g., stand with eyes open/close), step-ups, shoulder press, shoulder range of motion exercises, chest press, bicep curls, tricep extensions, core exercise, knee to chest, leg kicks, torso twists, modified squats, knee extensions, heel slides, side-to-side movements, calf raises, neck turn, seated backbend, up-down-push movements, stretching exercises, lateral flexion, overhead stretch, side stretch, hop stretch, calf stretches, ankle stretches, foot stretches, knee stretches, strength building/maintenance, among others.

The benefits of a chair consistent with the present disclosure may include, for example: improved user independence, reduced hospital visits, reduced need for at-home care, physical and occupational therapy visits, etc.

Various example embodiments may be more completely understood in view of the following detailed description presented in reference to the accompanying drawings.

Figure 1B:
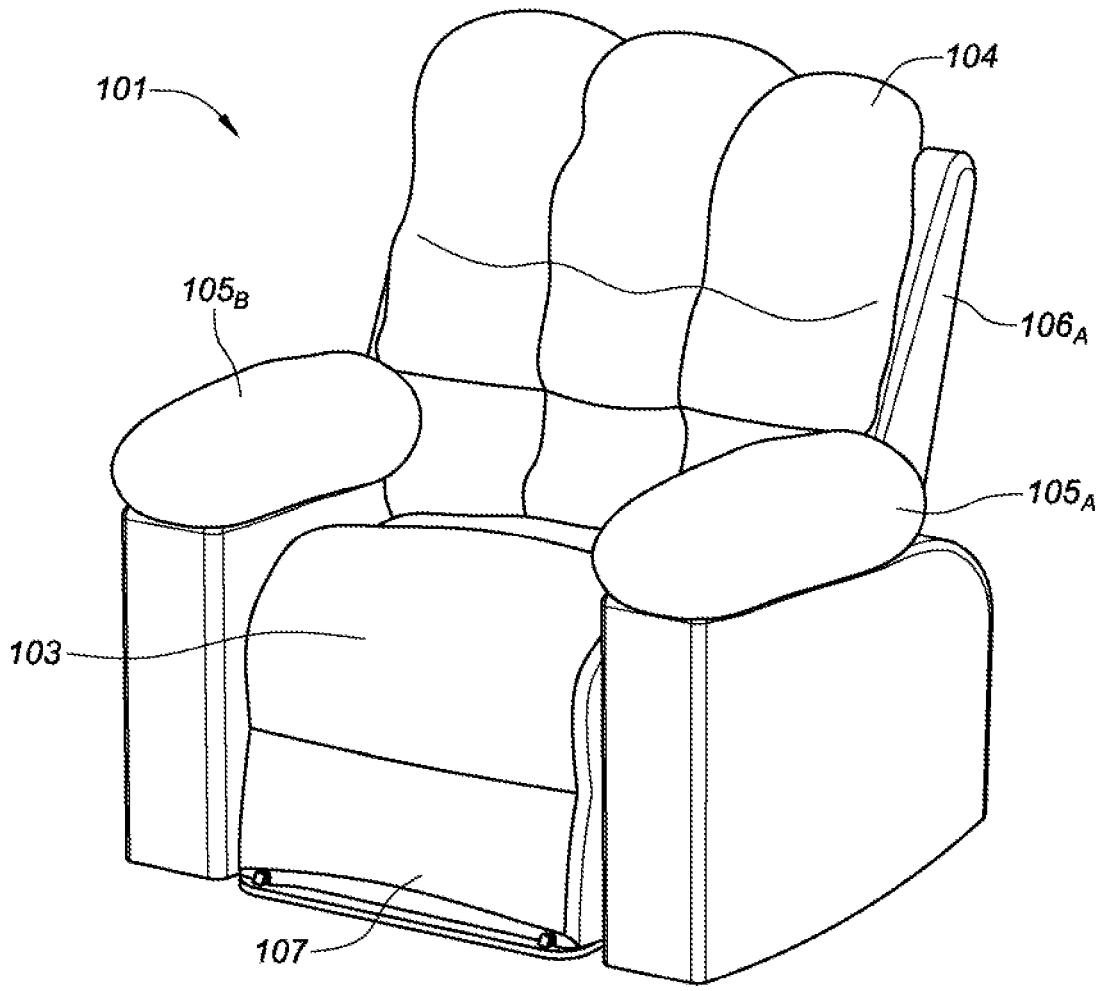
FIG. 1B is a front isometric view of the chair of FIG. 1A, consistent with various embodiments of the present disclosure.
Figure 1C:
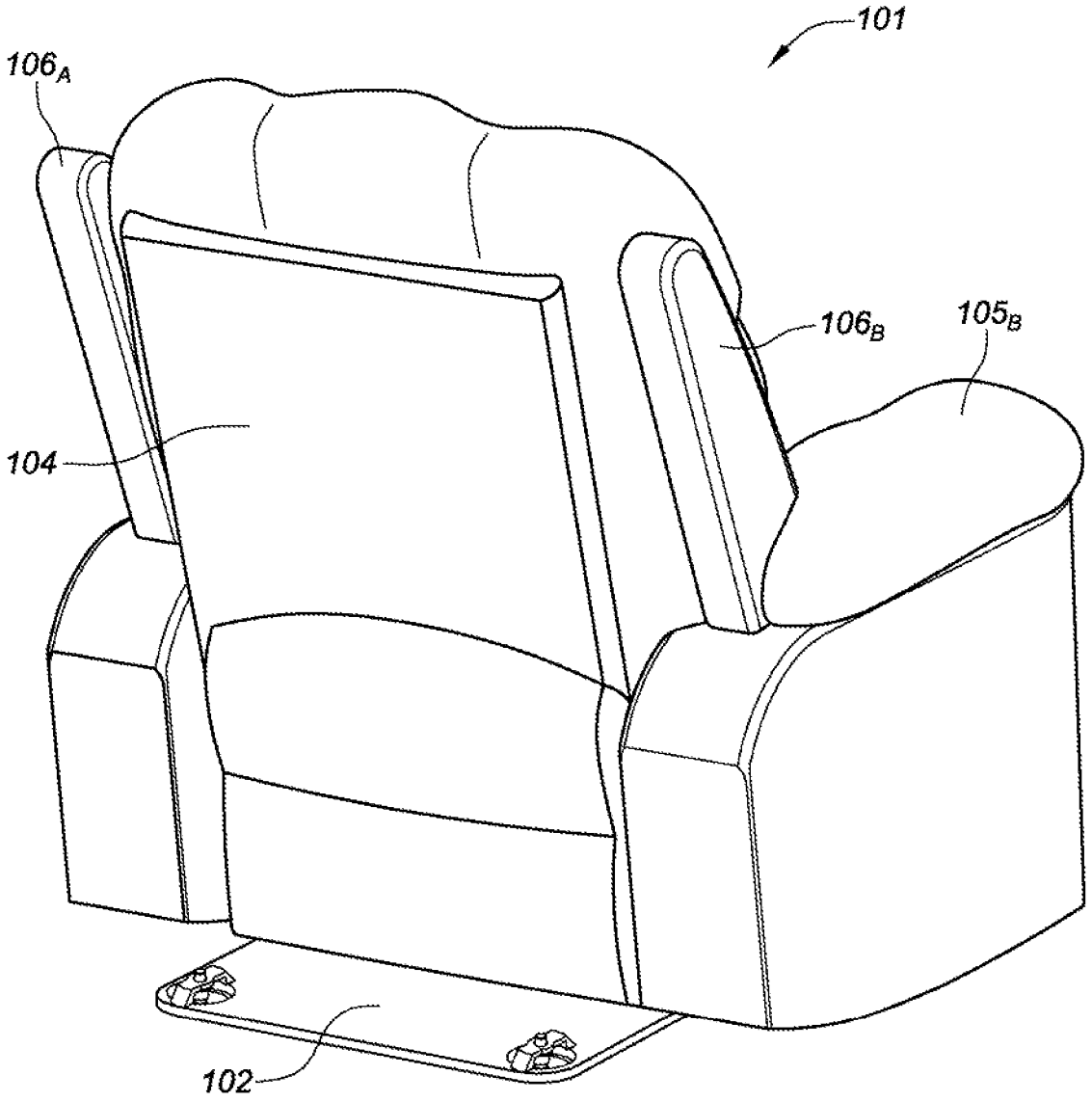
FIG. 1C is a rear isometric view of the chair of FIG. 1A, consistent with various embodiments of the present disclosure.

FIGS. 1A, 1B and 1C illustrate a chair 101 consistent with various embodiments of the present disclosure. The chair 101 includes a base 102, a seat 103, a backrest 104, primary armrests $\mathbf{105}_{A/B}$, auxiliary armrests $\mathbf{106}_{A/B}$, and a leg rest 107. As discussed in more detail below, the chair 101 includes a number of motion and rotation mechanisms that facilitate extension of the leg rest 107, reclining of the backrest 104, and lifting of the seat 103 to a vertical inclination. Rotation mechanisms may also be implemented between the seat 103 and backrest 104 which facilitate yaw and roll of the backrest 104 relative to the rest of the chair 101.

As discussed in more detail below, when the seat 103 is extended into a vertical inclination, auxiliary armrests $\mathbf{106}_{A/B}$ which are coupled to the backrest 104 may be lowered to provide a user additional support and the ability to carry some of their standing weight through their upper body. In some embodiments, the primary armrests $\mathbf{105}_{A/B}$ are coupled to a base 102 of the chair and remain static during various chair motions. In yet other embodiments, the primary armrests $\mathbf{105}_{A/B}$ may be coupled to the backrest 104 and rest on the base 103 of the chair 101 when the chair is in a seated configuration. In such an embodiment, the auxiliary armrests $\mathbf{106}_{A/B}$ are not necessary as the primary armrests serve both functions.

Figure 1D:
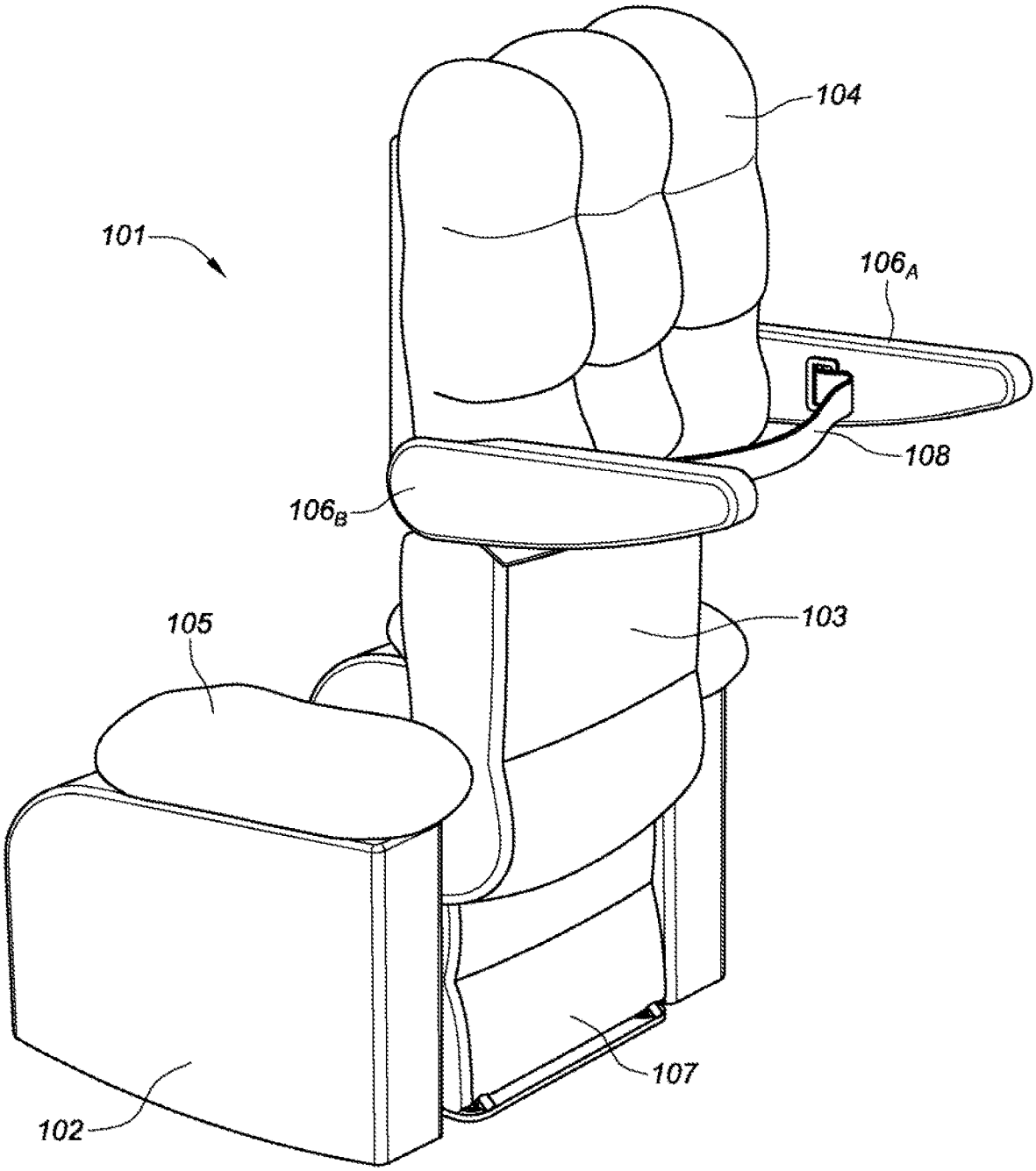
FIG. 1D is a right side isometric view of the chair of FIG. 1A in a standing configuration, consistent with various embodiments of the present disclosure.

FIG. 1D is a right side isometric view of the chair 101 of FIG. 1A in a standing configuration, consistent with various embodiments of the present disclosure. To arrive at the standing configuration from a seating configuration of the chair 101, a first mechanism (lifting mechanism) between base 102 and seat 103 causes the seat to incline relative to the base to (a near) vertical position, while a second mechanism (reclining mechanism) between the seat 103 and the backrest 104 rotates the backrest in the opposite (rotational) direction until both the backrest and seat are (substantially) vertical. The standing configuration facilitates a user entering/exiting the chair 101 by allowing the user to decrease the amount of their weight they must support during the transition between sitting and standing. That is, the user may exert a portion of their weight on the auxiliary armrests $\mathbf{106}_{A/B}$ throughout the transition period and the seat 103 shortly after motion of the chair 101 has begun.

As shown in FIG. 1D, the auxiliary armrests $\mathbf{106}_{A/B}$ are lowered/extended so that the user may utilize them for lateral stability and weight transfer onto the chair as they enter/exit. To further reduce the risk of falls during the transition between sitting and standing, various embodiments of the chair 101 include one or more seatbelts/restraints/harnesses 108 which secure the user to the chair. As shown in the embodiment of FIG. 1D, a seatbelt 108 is coupled to a backrest 104 proximal to a seat portion 103. Accordingly, the seatbelt is positioned in proximity to a user's waist to provide stability at a user's core during the transition between sitting and standing, while also being at a natural bending point of the body (the hips) which makes this location more comfortable during use. In yet other embodiments, a three-point (or five-point harness) may be utilized so that a user may also transfer a portion of their weight through the harness and they rise/descent (or during various exercises and stretches).

Figure 1E:
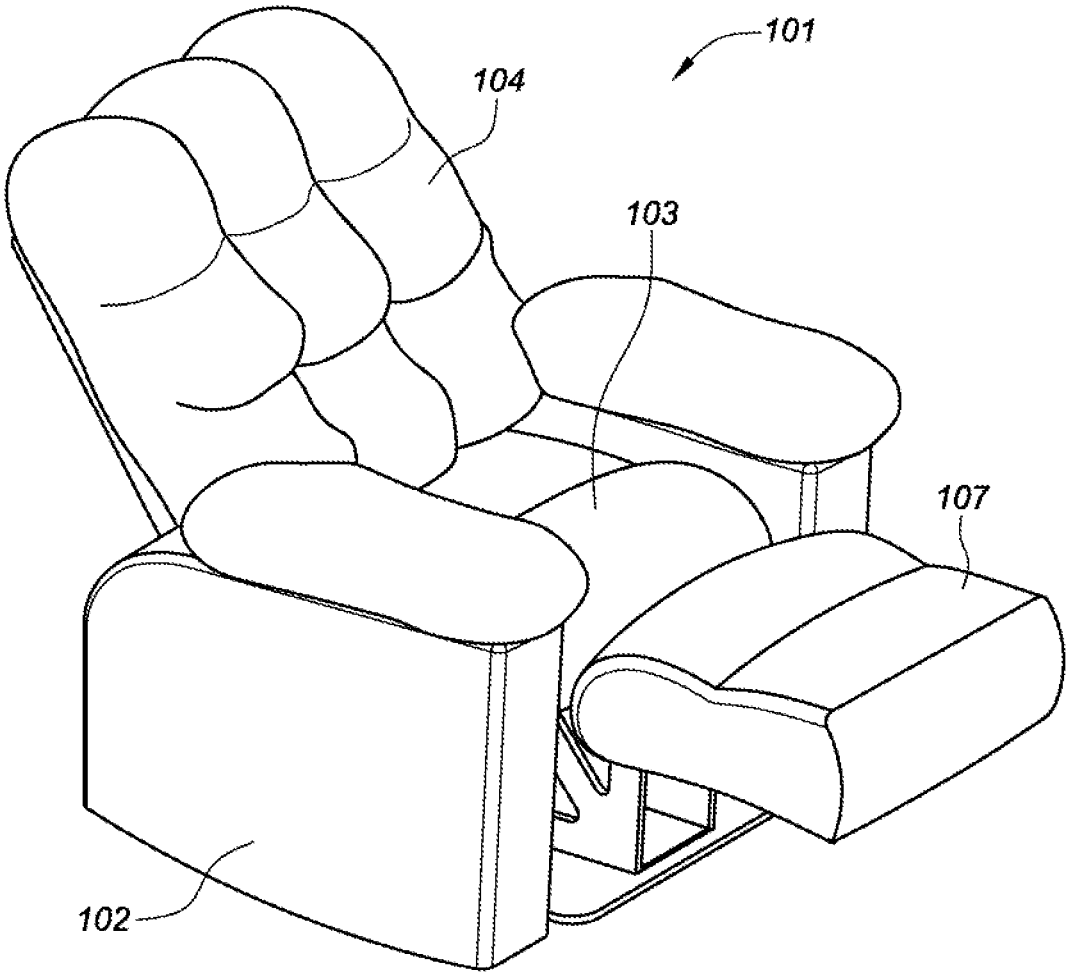
FIG. 1E is a right side isometric view of the chair of FIG. 1A in a reclined configuration, consistent with various embodiments of the present disclosure.

FIG. 1E illustrates a reclined configuration of chair 101, consistent with various embodiments of the present disclosure. The backrest 104 is reclined relative to the seat 103 by a reclining mechanism (discussed in more detail in reference to FIG. 2A/B). Optionally, the leg rest 107 may be independently extended relative to the backrest reclining by a leg rest mechanism (discussed in more detail in reference to FIG. 2C).

In various embodiments of the present disclosure, a user may individually control each mechanism (i.e., a reclining mechanism, a lifting mechanism, a leg rest mechanism, etc.) via a user interface (such as a remote) and/or by selecting a pre-programmed function (e.g., recline, stand, as well as various exercise and stretch programs).

Figure 1F:
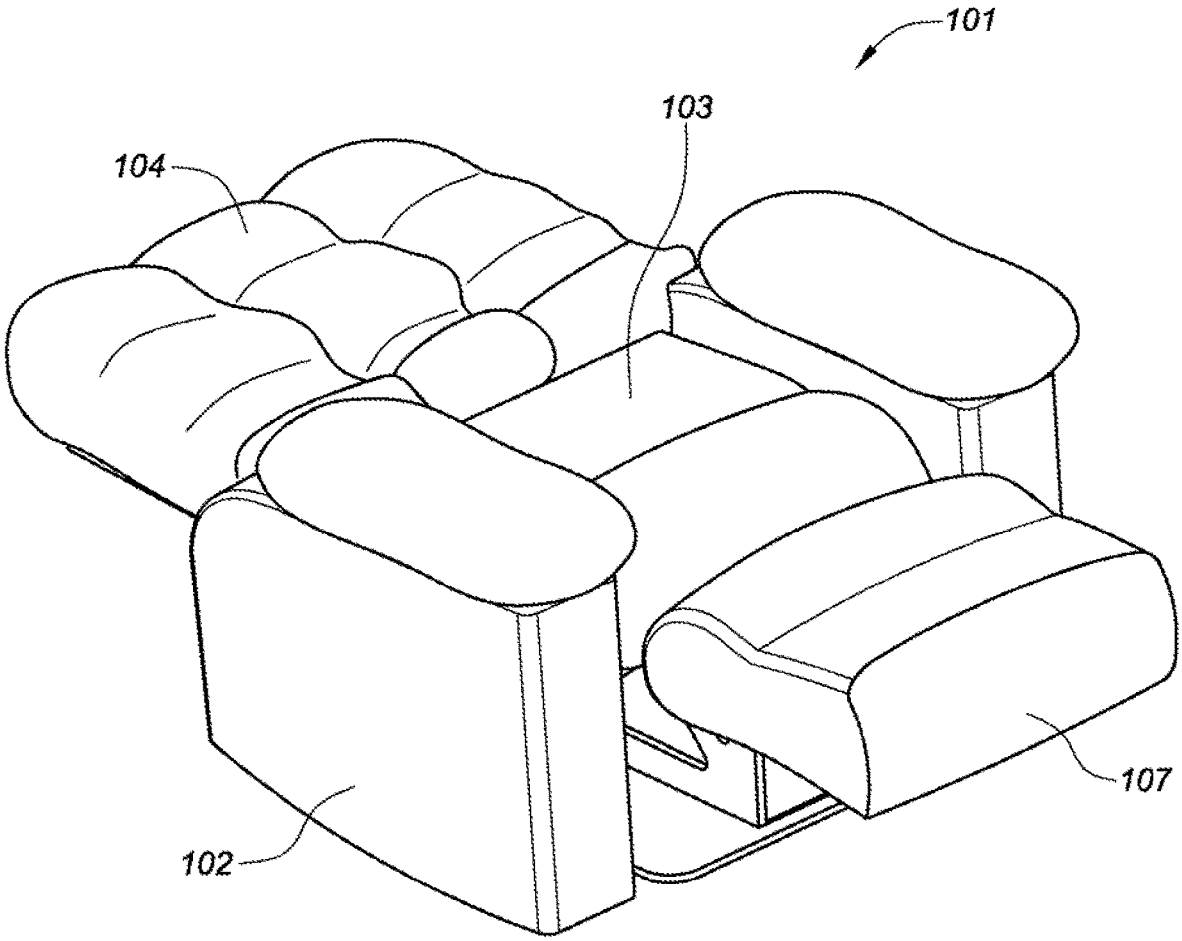
FIG. 1F is a right side isometric view of the chair of FIG. 1A in a supine configuration, consistent with various embodiments of the present disclosure.

FIG. 1F illustrates the chair 101 of FIG. 1A in a supine configuration, consistent with various embodiments of the present disclosure. In a supine configuration, the backrest 104, seat bottom 103, and leg rest 107 are all (substantially) horizontally orientated at approximately the same elevation. To arrive at the supine configuration from the seated configuration, the reclining mechanism and leg rest mechanism must be operated. Using servo motors, for example, each of these particular positions (seating configurations) may be accurately repeated by controller circuitry of the chair 101.

In yet further embodiments, a reclining mechanism may further extend the backrest so to place the user into the Trendelenburg position (where the user's head is lower than the rest of their body). That is, the seat bottom 103 and leg rest 107 are (substantially) horizontally oriented and the backrest 104 is declining relative thereto. In such an embodiment, the reclining mechanism facilitates a rotation between the seating configuration and the Trendelenburg position of approximately 180 degrees.

For clarity, FIGS. 1E/F are illustrated without auxiliary armrests $\mathbf{106}_{A/B}$. However, in some embodiments the auxiliary armrests $\mathbf{106}_{A/B}$ may be removeable as desired. Alternatively, the auxiliary armrests $\mathbf{106}_{A/B}$ may be rotationally coupled to facilitate swinging the auxiliary armrests $\mathbf{106}_{A/B}$ out of the way when not in use. In yet other embodiments, auxiliary armrests $\mathbf{106}_{A/B}$ may be telescoping and extend/retract out of the backrest 104. In yet more specific embodiments, the auxiliary armrests $\mathbf{106}_{A/B}$ may be stored in a storage compartment of base 102 (as shown in reference to FIG. 6A) while the chair 101 is in a seated configuration (among others).

Figure 1G:
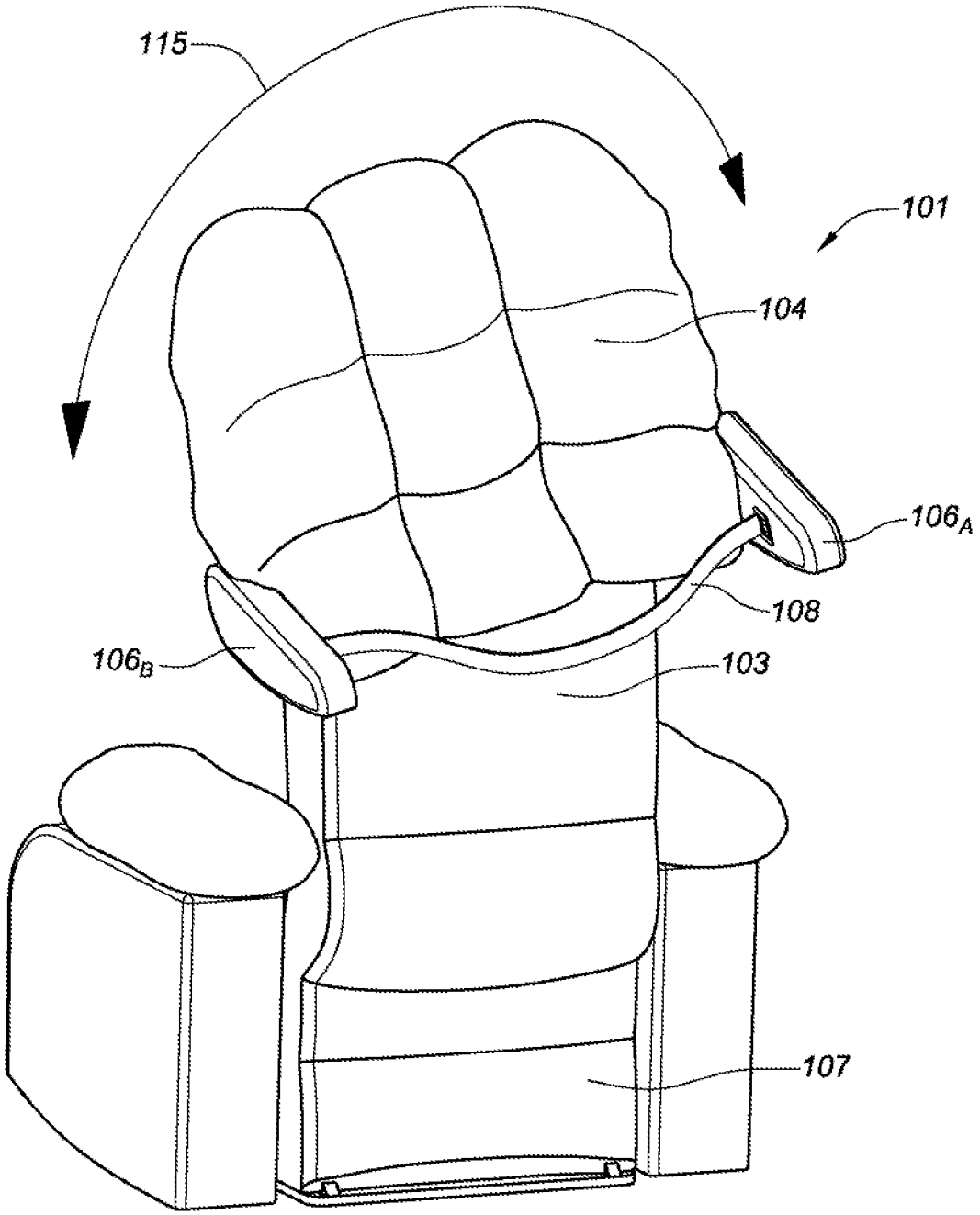
FIG. 1G is an isometric view of the chair of FIG. 1A in a standing configuration with the back-rest rolling with respect to the rest of the chair, consistent with various embodiments of the present disclosure.

FIG. 1G illustrates a standing configuration of chair 101 with the backrest 104 rolling 115 back-and-forth with respect to the rest of the chair. As discussed above with respect to FIG. 1D, in the standing configuration the various mechanisms (lifting mechanism, reclining mechanism, and leg rest support) of the chair position the leg rest 107, seat 103 and backrest 104 all into (substantially) vertical alignment. When in the standing configuration, a user utilizing the chair 101 is standing immediately adjacent the seat. The user may be secured to the chair with seatbelt 108 and have their forearms resting on auxiliary armrests $\mathbf{106}_{A/B}$. The rolling motion 115 of the backrest allows the user to conduct, for example side-to-side stretching, and/or oblique strengthening exercises in a controlled environment greatly reducing the likelihood of an injury (such as a fall). Particularly, where the user loses their lateral stability, the seatbelt 108 and/or auxiliary armrests $\mathbf{106}_{A/B}$ may facilitate the user restoring their balance. In addition, where the user is unable to carry their entire weight through their legs, the user may carry a portion of their weight through their forearms via the auxiliary armrests $\mathbf{106}_{A/B}$.

It is to be understood that controller circuitry of the chair 101 may facilitate motion of one or more of the mechanisms simultaneously to facilitate fluid multi-axis motions of the chair 101 thereby allowing the user to naturally stretch and exercise in conjunction with the chair. A user interface of the chair, communicatively coupled to the controller circuitry, allows the user to select a single stretch/exercise, pre-programmed exercise/stretch routines, and/or create customized stretch/exercise routines.

Figure 1H:
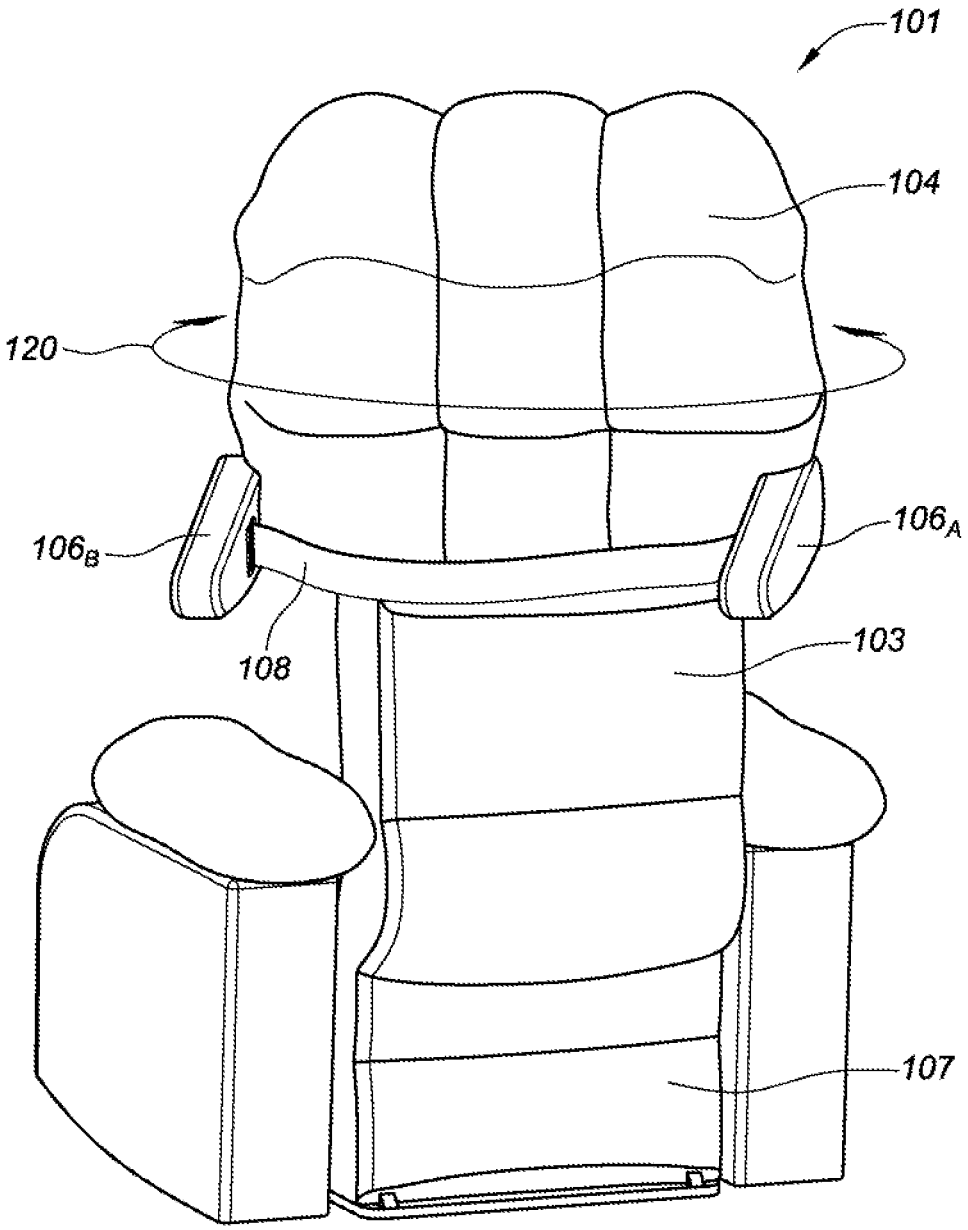
FIG. 1H is an isometric view of the chair of FIG. 1A in a standing configuration with the back-rest yawing with respect to the rest of the chair, consistent with various embodiments of the present disclosure.

FIG. 1H illustrates a standing configuration of chair 101 with the backrest 104 yawing 120 with respect to the rest of the chair. When in the standing configuration, a user utilizing the chair 101 is standing immediately adjacent the seat. The user may be secured to the chair with seatbelt 108 and have their forearms resting on auxiliary armrests $\mathbf{106}_{A/B}$. The yawing motion 120 of the backrest 104 allows the user to conduct rotational stretching of their upper-body in a controlled environment greatly reducing the likelihood of an injury (such as a fall). Particularly, where the user loses their lateral stability, the seatbelt 108 and/or auxiliary armrests $\mathbf{106}_{A/B}$ may facilitate the user restoring their balance. In addition, where the user is unable to carry their entire weight through their legs, the user may carry a portion of their weight through their forearms via the auxiliary armrests $\mathbf{106}_{A/B}$.

In one specific embodiment, yaw motion 120 may be implemented simultaneously with a inclining/reclining motion of the chair to allow the user to conduct assisted rotational crunches and/or oblique crunches from a semi-upright or reclined position of the chair 101.

In some specific embodiments, the yaw and roll motions illustrated in FIGS. 1G and 1H (in addition to one or more of the other motions of the chair disclosed herein) may be conducted in series or simultaneously, as may be necessary for various stretching and strength training exercises. These various stretches and exercises may be programmed into controller circuitry for the various mechanisms of the chair to facilitate a user individually selecting a stretch or exercise, or selecting a pre-programmed set of stretches/exercises.

Figure 2A:
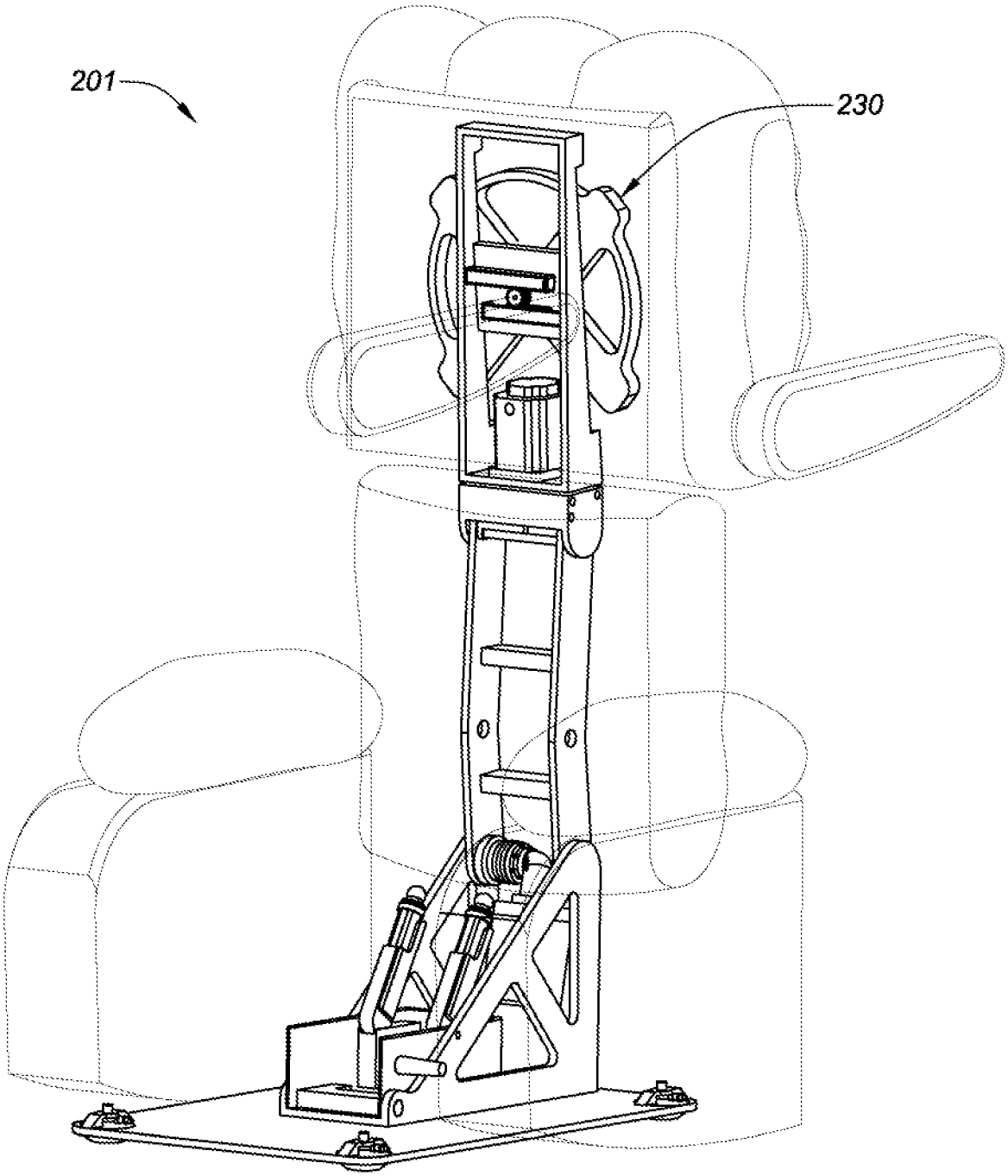
FIG. 2A is an isometric back view of a chair with the outer structure transparent to further illustrate the underlying chair structure, consistent with various embodiments of the present disclosure.
Figure 2B:
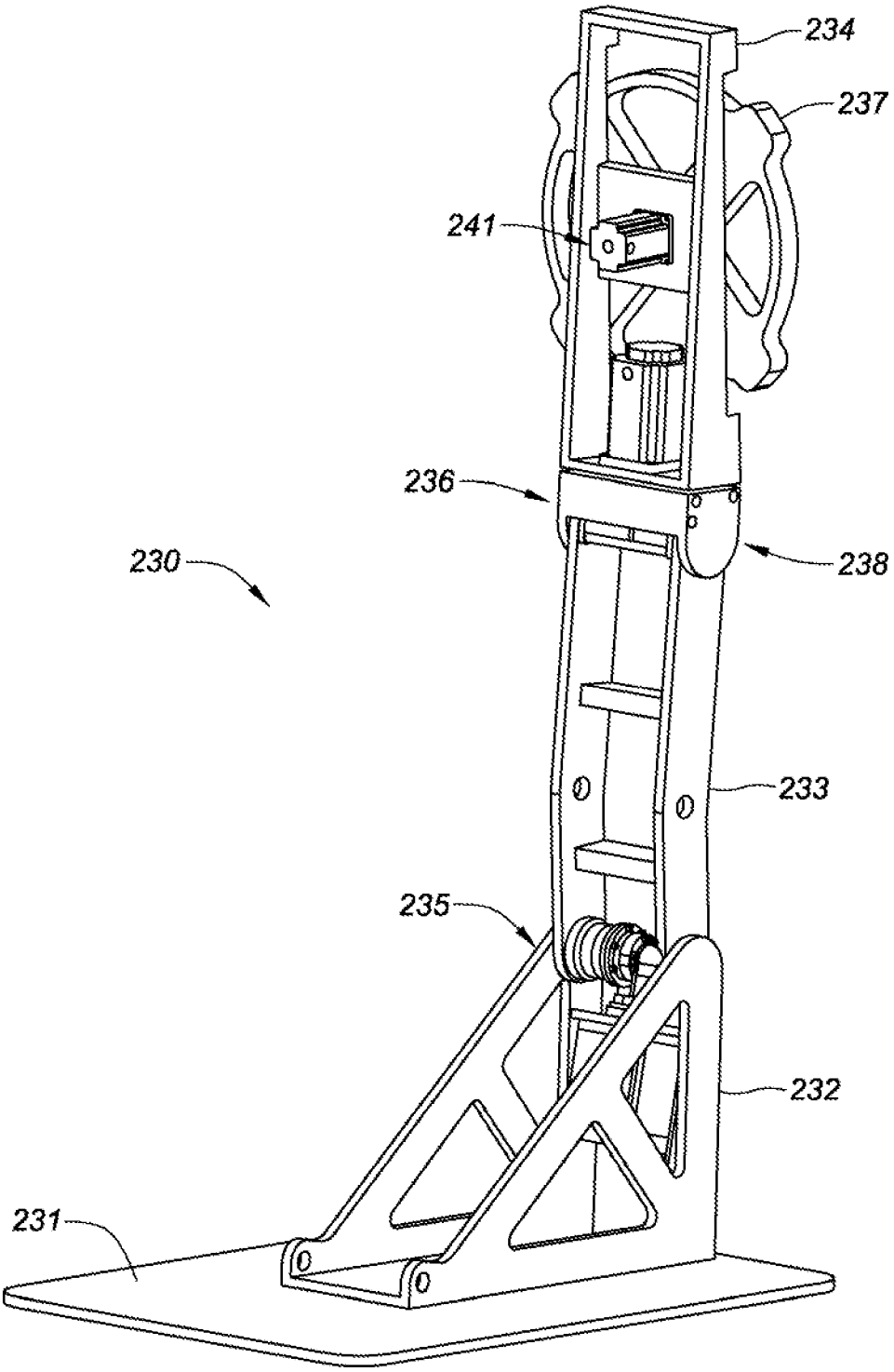
FIG. 2B is an isometric back view of the underlying chair structure of the FIG. 2A chair, consistent with various embodiments of the present disclosure.

FIG. 2A is an isometric back view of a chair 201 with the outer structure illustrated in transparency to show the underlying chair structure 230, consistent with various embodiments of the present disclosure. In FIG. 2B, the underlying chair structure 230 is shown in a standing configuration. A base plate 231 is coupled to a base mount 232. The base mount 232 is then rotationally coupled to a seat support structure 233 via lifting mechanism 235. The seat support structure 235 is then rotationally coupled to the back support structure 234 via a reclining mechanism 238 and yaw mechanism 236. Finally, the back support structure 234 is coupled to a backrest mount 237 via the roll mechanism 241.

Controller circuitry may simultaneously (or in series) operate one or more of these various mechanisms to facilitate a user desired motion of the chair 201.

As shown in FIG. 2B, the various support structures are ladder frame designs for improved structural rigidity while minimizing overall weight. However, it is to be appreciated that various other support structure designs/shapes may be readily implemented. For example, each support structure may consist of a central spine with lateral splines extending therefrom.

Figure 2C:
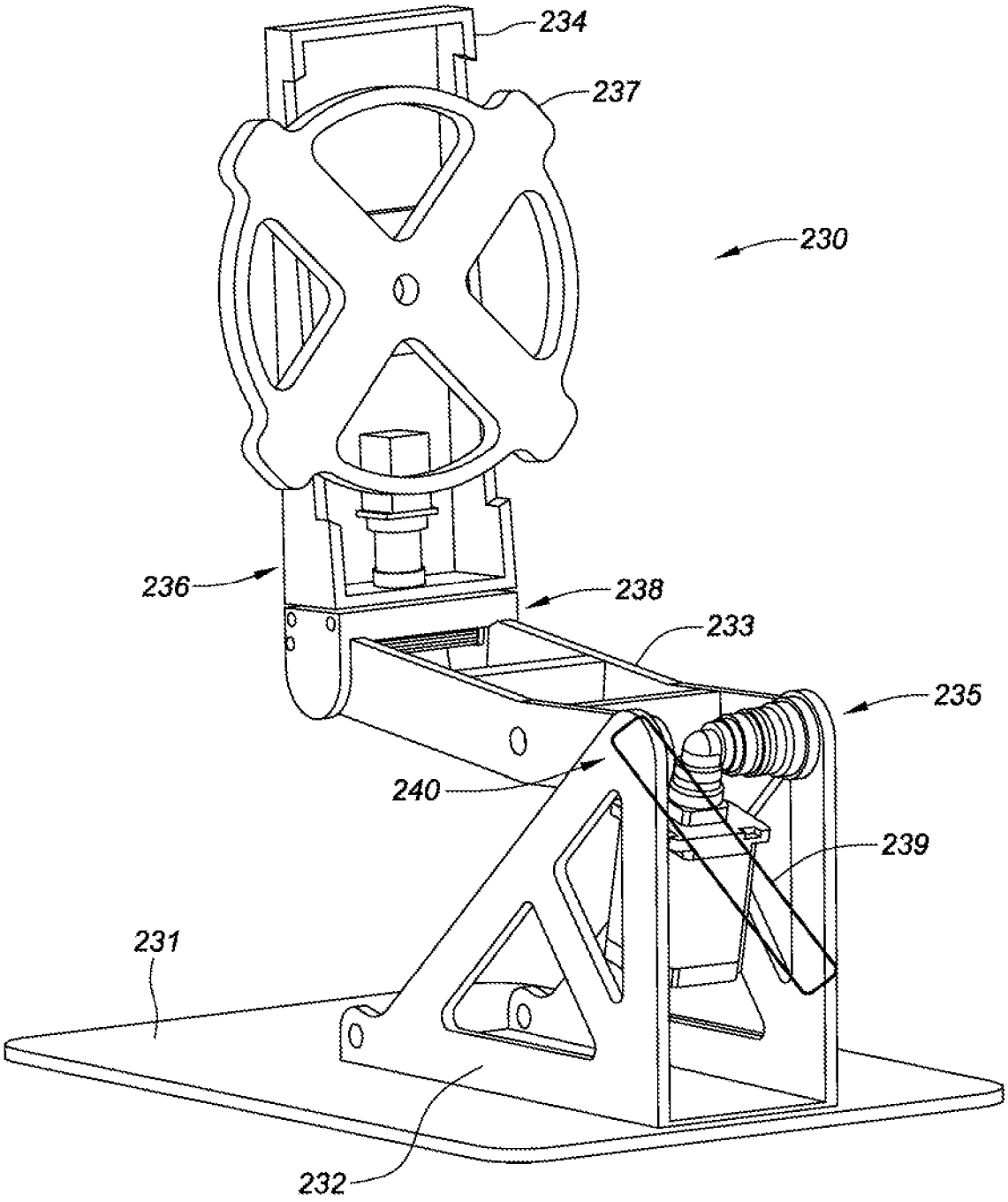
FIG. 2C is an isometric front view of the underlying chair structure of FIG. 2B, consistent with various embodiments of the present disclosure.

FIG. 2C is an isometric front view of the underlying chair structure 230 in a seating configuration. As more clearly shown in FIG. 2C, the underlying chair structure 230 further includes a leg rest support 239 which is rotationally coupled to the base mount 232 via leg rest mechanism 240. While the leg rest mechanism 240 shares the same hinge axis as the lifting mechanism 235, the leg rest mechanism 240 may operate independently of the lifting mechanism 235.

To achieve the up-right seating configuration (shown in FIG. 2C) from the standing configuration (shown in FIG. 2B), reclining mechanism 238 rotates in a clockwise direction re-positioning the back support structure 234 relative to the seat support structure 233 into an approximately 90 degree angle. Similarly, the lifting mechanism 235 rotates in a counter-clockwise direction repositioning the seat support structure 233 to be (substantially) horizontal.

To achieve the roll rotation illustrated in FIG. 1G, a roll mechanism 241 (shown in FIG. 2B) is activated by controller circuitry. In various embodiments of the present disclosure, the roll mechanism may be a servo/motor encoder mounted to the back support structure 234 and directly rotates the backrest mount 237 (to which the backrest 104 is mounted). In an alternative embodiment, the roll mechanism is a rack and pinion design (as discussed in more detail in reference to FIG. 4A).

Figure 3A:
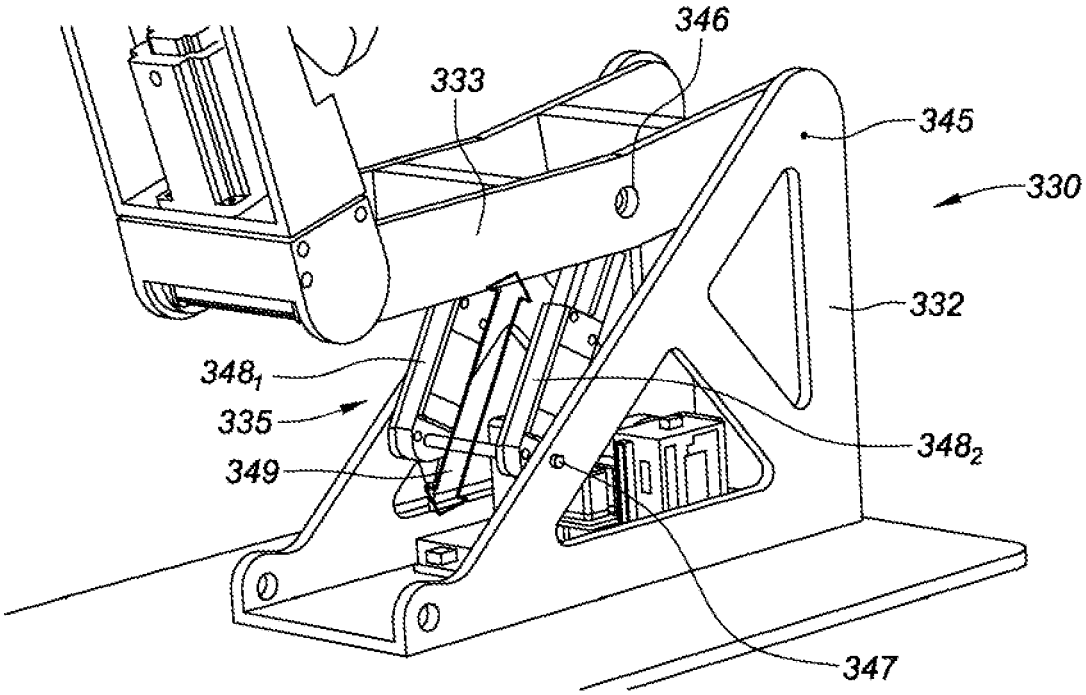
FIG. 3A is a close-up isometric right side view of a first embodiment of a lifting mechanism of the underlying chair structure of FIG. 2B, consistent with various embodiments of the present disclosure.

FIG. 3A is a close-up isometric back view of a first embodiment of a lifting mechanism 335 of the underlying chair structure 330 of FIG. 2B, consistent with various embodiments of the present disclosure. Base mount 332 and seat support structure 333 are rotatably coupled together at a first hinge point 345. One or more linear actuators 3481/2 are coupled between the base mount 332 and seat support structure 333 at a mechanically advantageous position. For example, as shown in FIG. 3A, two linear actuators 3481/2 are rotationally coupled to the base mount 332 at second hinge point 347 and the seat support structure 333 at third hinge 346. In response to an electrical signal from seat controller circuitry, the linear actuators 3481/2 effect positive/negative linear motion 349. As the base mount 332 is static, the linear motion 349 effects the pitch of the seat support structure 333 (and back support structure 234).

Figure 3B:
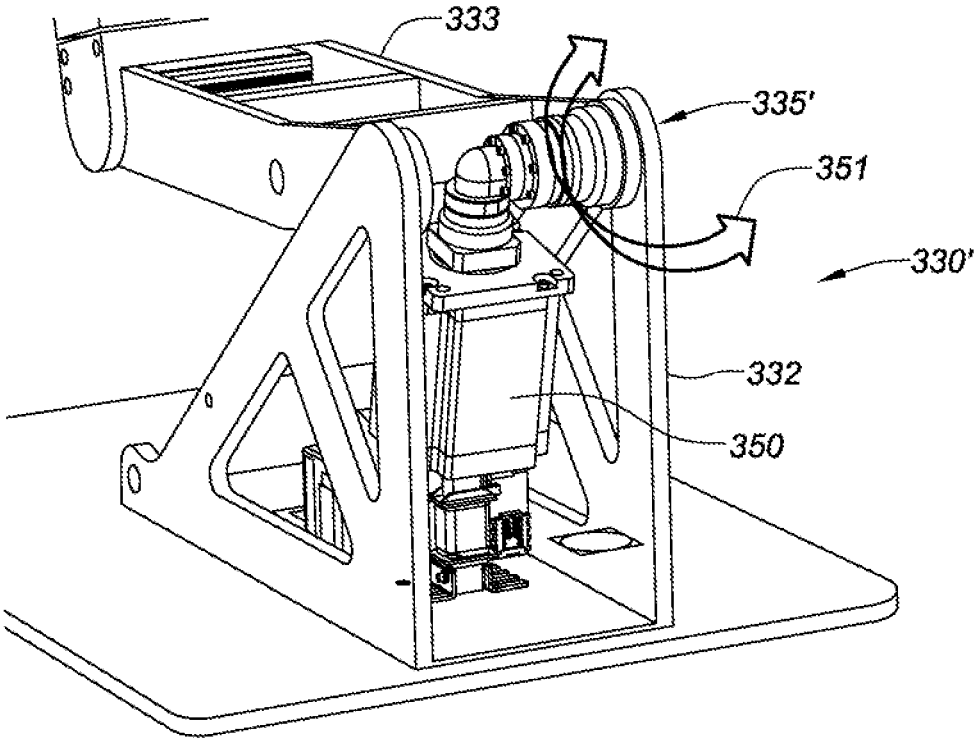
FIG. 3B is a close-up isometric front view of a second embodiment of a lifting mechanism of the underlying chair structure of FIG. 2B, consistent with various embodiments of the present disclosure.

FIG. 3B is a close-up isometric front view of a second embodiment of a lifting mechanism 335' of the underlying chair structure 330' of FIG. 2B, consistent with various embodiments of the present disclosure. Base mount 332 and seat support structure 333 are rotatably coupled together at a first hinge point 345 (as shown in FIG. 3A). The lifting mechanism 335' includes a (servo) motor 350 this is statically coupled to the base mount 332 and is rotatably coupled to the seat support structure 333 along an axis of the first hinge point 345. In response to an electrical signal from seat controller circuitry, the (servo) motor 350 effects (counter-) clockwise rotation motion 351. As the base mount 332 is static, the rotation motion 351 effects the pitch of the seat support structure 333 (and back support structure 234).

In one specific embodiment of the lifting mechanism 335', the motor may be a servo motor with planetary gear reducers to increase torque needed to lift a user of the chair.

Figure 4A:
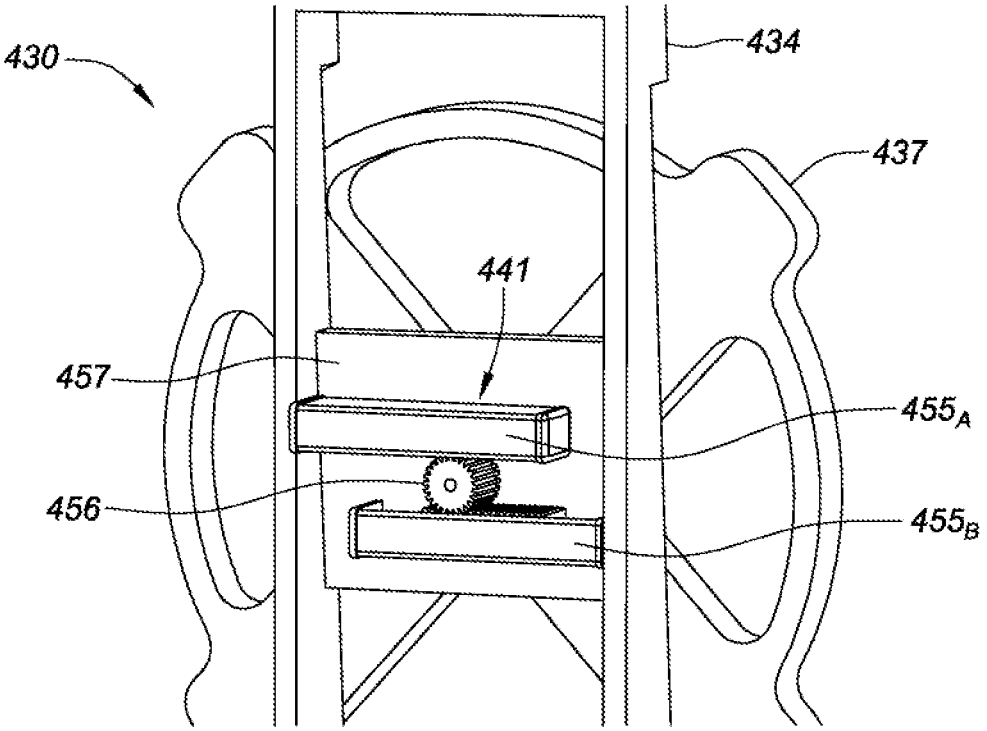
FIG. 4A is a close-up isometric back view of a first embodiment of a roll mechanism of the underlying chair structure of FIG. 2B, consistent with various embodiments of the present disclosure.

FIG. 4A is a close-up isometric back view of a first embodiment of a roll mechanism 441 of the underlying chair structure 430 of FIG. 2B, consistent with various embodiments of the present disclosure. The roll mechanism 441 is mounted on a brace 457 of a back support structure 434. In the present embodiment, the roll mechanism 441 is a rack and pinion design. The racks $\mathbf{455}_{A/B}$, in response to an electrical signal from controller circuitry, induce a (counter-) clockwise rotation of pinion 456 which is directly coupled to a backrest mount 437 (and backrest 104). The pinion 456 may be rotatably coupled to a shaft which extends through a bearing in the brace 457 and coupled to the backrest mount 437 on the opposite side to reduce the effect of friction on the roll mechanism 441.

Figure 4B:
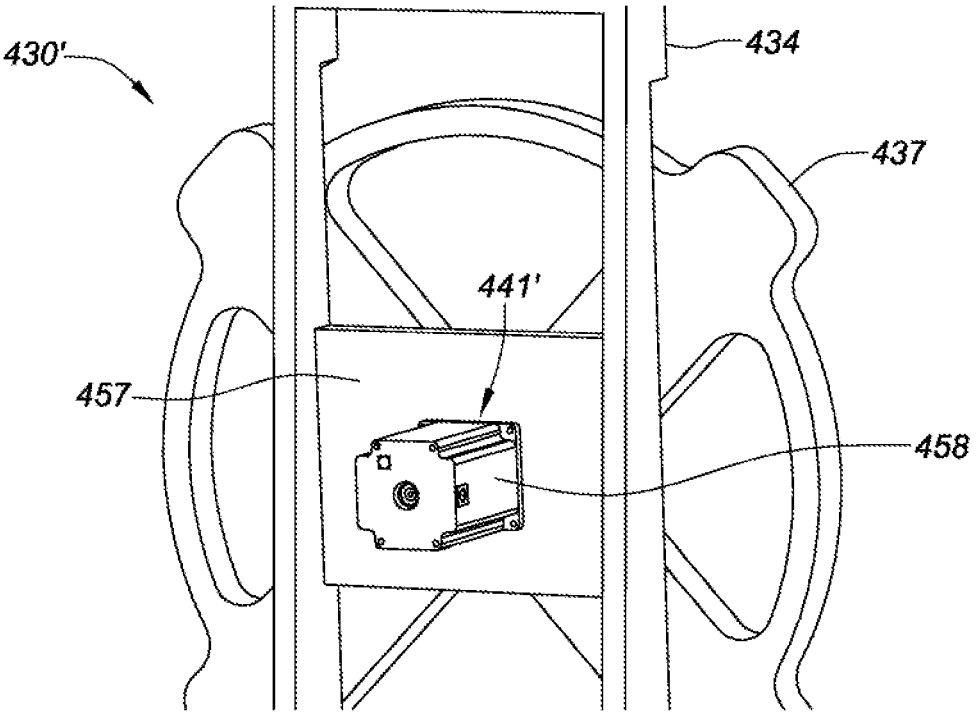
FIG. 4B is a close-up isometric back view of a second embodiment of a roll mechanism of the underlying chair structure of FIG. 2B, consistent with various embodiments of the present disclosure.

FIG. 4B is a close-up isometric back view of a second embodiment of a roll mechanism 441' of the underlying chair structure 430' of FIG. 2B, consistent with various embodiments of the present disclosure. The roll mechanism 441' includes a (servo) motor 458 mounted on brace 457 of back support structure 434. The motor 458 may be directly coupled to the backrest mount 437 via a drive shaft of the motor that extends through an aperture in the brace 457. In an alternative embodiment, the roll mechanism 441' may further include gearing to increase torque.

Figure 5A:
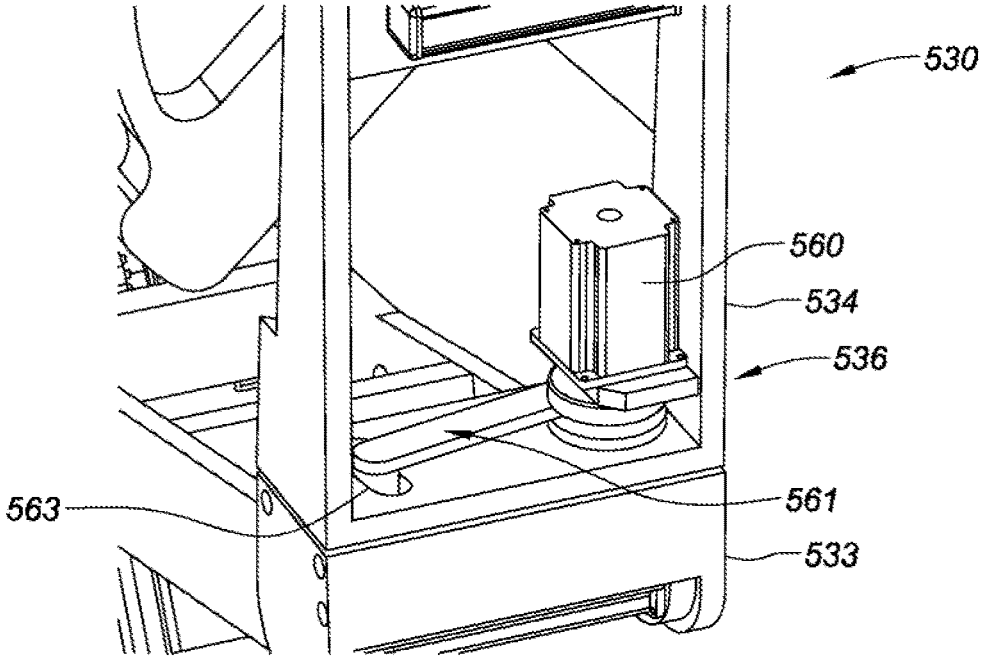
FIG. 5A is a close-up isometric back view of a first embodiment of a yaw mechanism of the underlying chair structure of FIG. 2B, consistent with various embodiments of the present disclosure.

FIG. 5A is a close-up isometric back view of a first embodiment of a yaw mechanism 536 of the underlying chair structure 530 of FIG. 2B, consistent with various embodiments of the present disclosure. The yaw mechanism 536 includes a rotary motor 560 coupled to a back support structure 534 and further utilizes a 4-bar mechanical linkage 561 coupled to the drive shaft of the motor 560 and the seat support structure 533 to affect yaw adjustment between the back support structure 534 and seat support structure 533 in response to a rotation of the motor 560 initiated by an electrical signal transmitted from seat controller circuitry. In some specific embodiments, the yaw mechanism 536 may further include hard stops 563 which limit the total yaw adjustment the yaw mechanism may induce between the back support structure 534 and seat support structure 533.

Figure 5B:
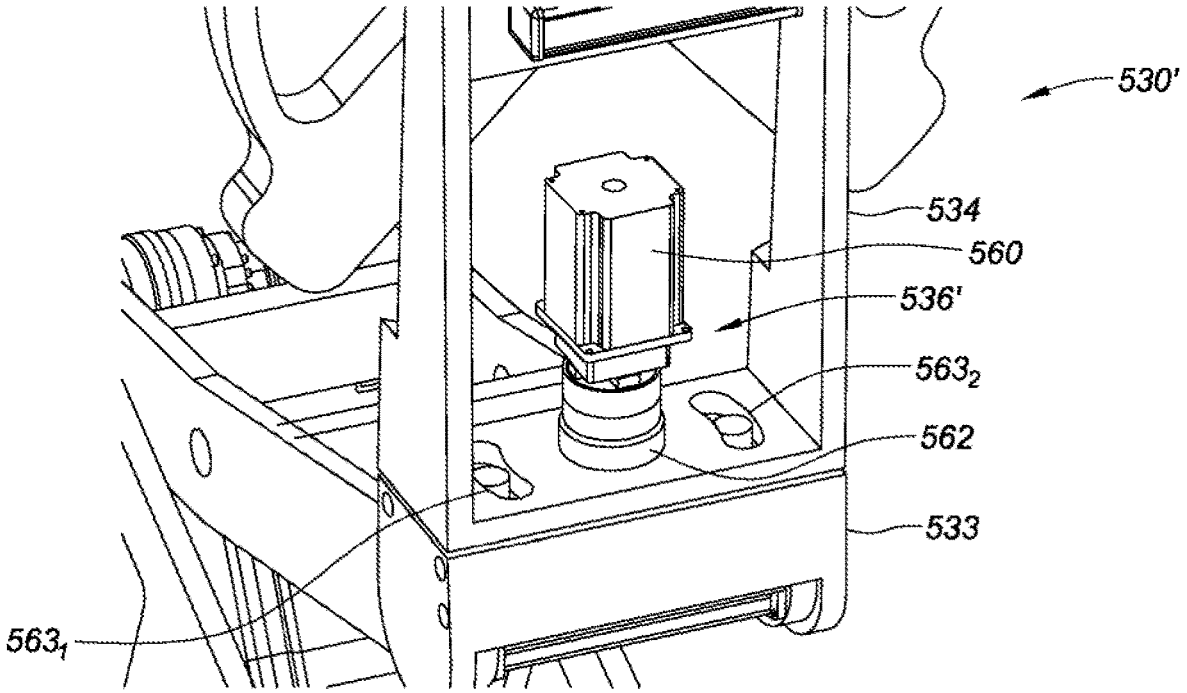
FIG. 5B is a close-up isometric front view of a second embodiment of a yaw mechanism of the underlying chair structure of FIG. 2B, consistent with various embodiments of the present disclosure.

FIG. 5B is a close-up isometric front view of a second embodiment of a yaw mechanism 536' of the underlying chair structure 530' of FIG. 2B, consistent with various embodiments of the present disclosure.

In some specific embodiments, the yaw mechanism 536' may further include a yaw limiting mechanism $\mathbf{563}_{1\text{-}2}$ which limits the total yaw adjustment the yaw mechanism may induce between the back support structure 534 and seat support structure 533. As shown in FIG. 5B, the yaw limiting mechanism $\mathbf{563}_{1\text{-}2}$ includes grooves that extend circumferentially about a longitudinal axis of the motor 560 into a surface of the back support structure 534, and complimentary pins that are coupled to the seat support structure 533 extend up through a portion of the grooves. The yaw mechanism's yaw adjustment is mechanically limited when the pins come into contact with ends of the grooves.

It is to be understood that the various mechanisms disclosed herein (e.g., lifting mechanism, roll mechanism, yaw mechanism, and leg rest mechanism) may utilize any one of the various mechanism solutions disclosed in the present application with respect to other portions of the chair.

As shown in FIG. 5B, the motor 560 is coupled to the back support structure 534 via a direct coupling 562. A drive shaft of the motor 560 extends through the direct coupling 562 and an aperture extending through a portion of the back support structure 534, and is coupled to the seat support structure 533. In response to an electrical signal from seat controller circuitry, the motor 560 induces a torque between the back support structure 534 and the seat support structure 533 to effect yaw motion therebetween.

Figure 6A:
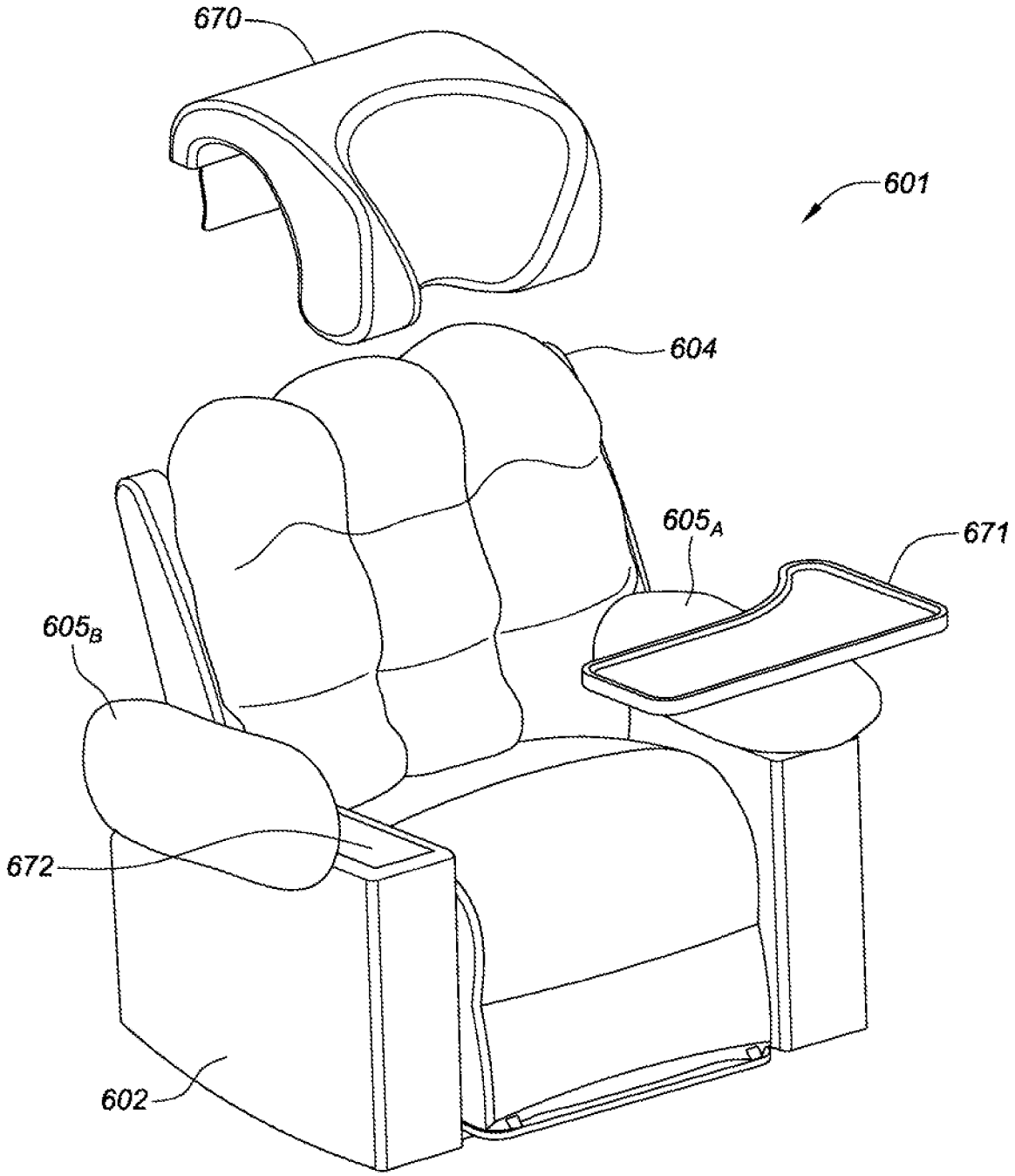
FIG. 6A is an isometric front view of a chair including a number of accessories, consistent with various embodiments of the present disclosure.
Figure 6B:
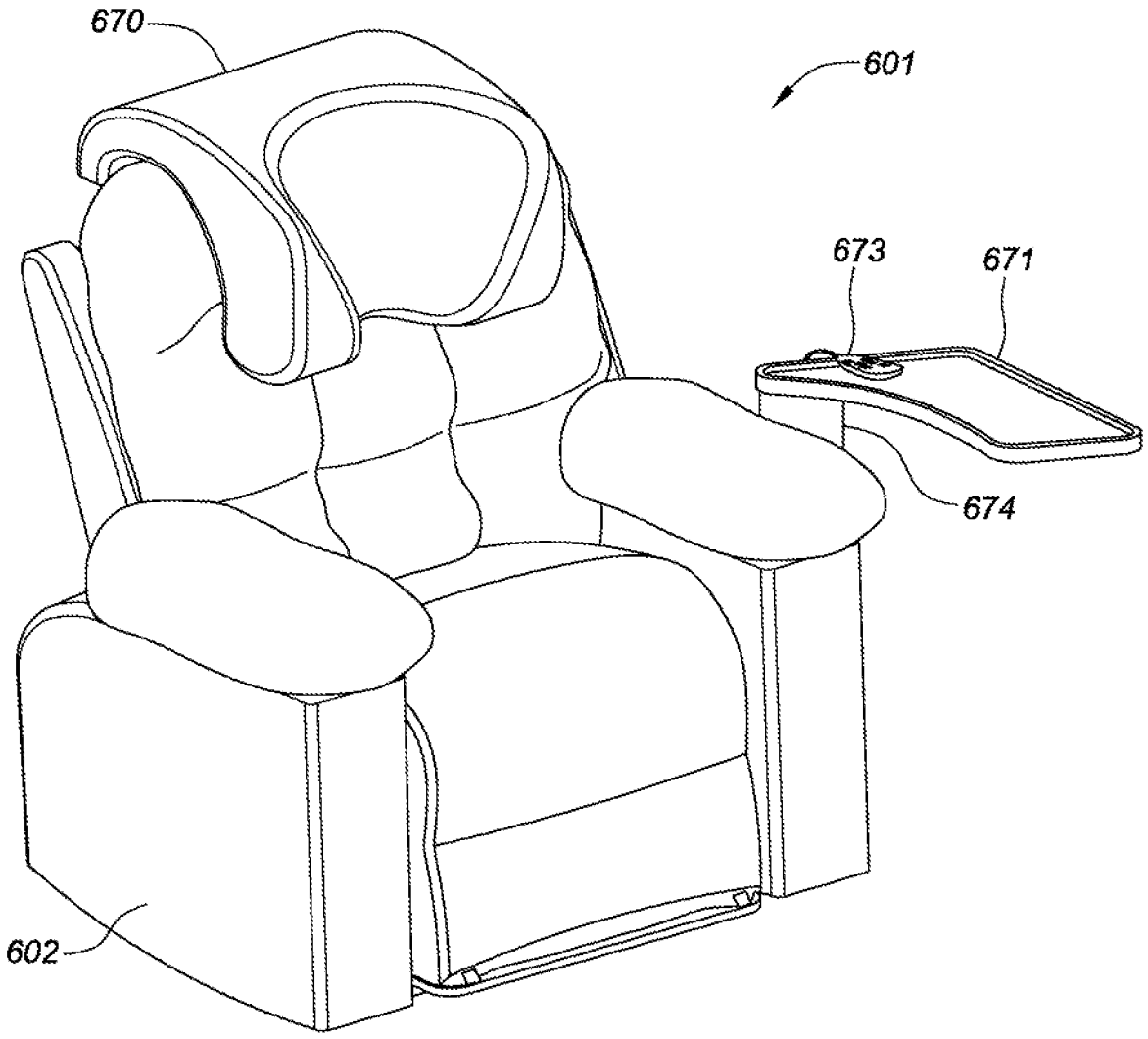
FIG. 6B is an isometric front view of a chair including a number of accessories, consistent with various embodiments of the present disclosure.

FIGS. 6A and 6B are isometric front views of a chair 601, consistent with the present disclosure, including a number of accessories. The chair 601 may include a headrest 670 which is removeable. Moreover, in some embodiments, the headrest 670 may be adjustable in height relative to the backrest 604 to accommodate users of various heights. The headrest 670 may be compression fit to a top of the backrest 604 or be mechanically coupled thereto.

The chair 601 may further include storage compartments 672 under one or more of the primary armrests $\mathbf{605}_{A/B}$. As shown in FIG. 6A, the primary armrests may be hinged on one side to allow for access to the storage compartment thereunder.

The chair 601 may further include a table 671 coupled to a base 602 of the chair via a table support 674. The table support 674 may be telescoping to facilitate various table heights. In some embodiments, the table 671 may be collapsed into the storage compartment 672 of primary armrest $\mathbf{605}_{A}$ and stored therein.

To facilitate user control of the chair 601, the chair may further include a wired/wireless controller 673 or other user interface (such as a touch-screen tablet) that allows for a user to select various functions of the chair including various stretches and exercises as discussed herein. Controller circuitry of the chair 601 may include wireless communication modules, such as a wireless communication module capable of Bluetooth® communication protocol, to facilitate receiving control inputs from a user's cellphone, tablet, or other electronics device.

Figure 7:
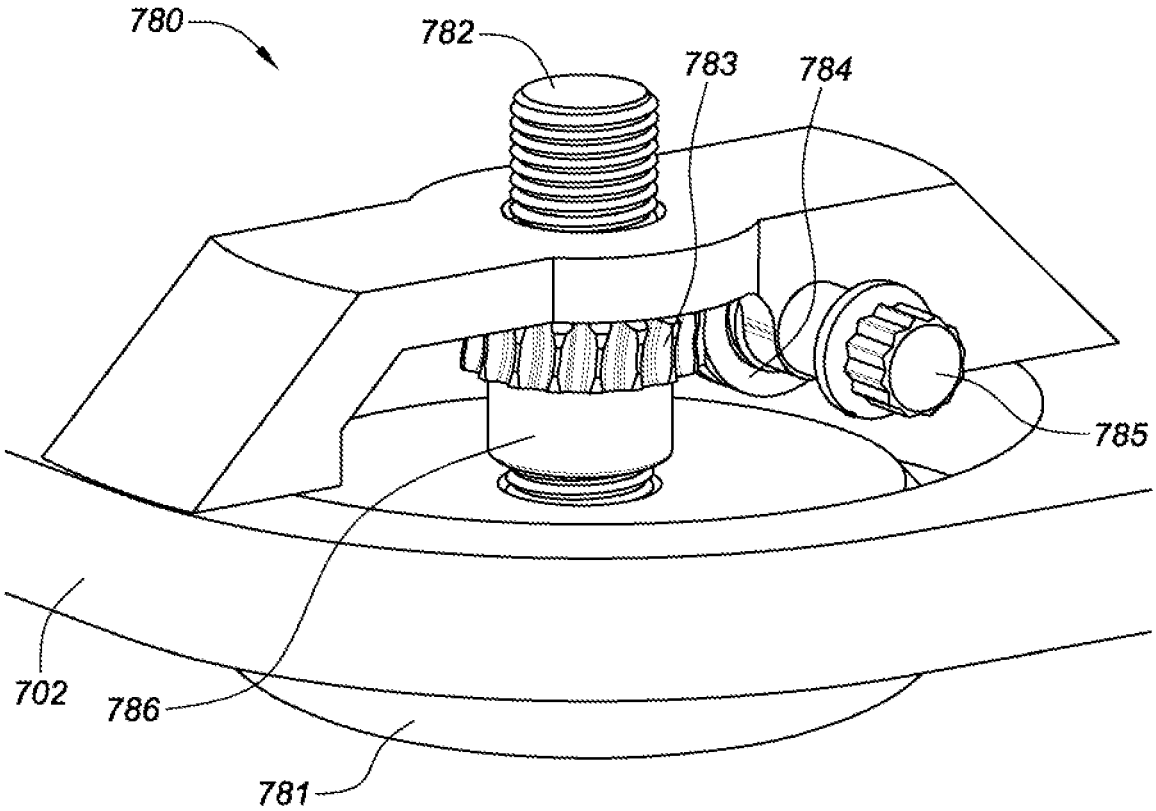
FIG. 7 is a retractable foot/slider assembly for use with furniture, consistent with various embodiments of the present disclosure, While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

FIG. 7 is a retractable foot/slider assembly 780 for use with furniture (among various other applications which will be clear to a skilled artisan in view of Applicant's disclosure herein), consistent with various embodiments of the present disclosure. In one embodiment of the present disclosure the assembly 780 may be used to extend one or more sliders 781 which facilitate movement of the item supported by the assembly on a hard surface, carpet, etc. In such an embodiment, when the furniture is in use, the sliders 781 are retracted and the furniture interacts with a floor via the base 702 of the assembly. In yet other embodiments, the assembly 780 may be used to level furniture. In such an embodiment, each corner of the furniture may have an assembly 780 and a user may adjust each foot 781 independently to achieve a desired level.

In operation, retractable foot/slider assembly 780 may receive an input torque on drive input 785 (via a user) which turns a primary gear 784 (worm gear) coupled to the same input shaft as the drive input 785. Rotation of the worm gear 784 rotates secondary gear 783 (with a mechanical advantage). The secondary gear 783 is coupled to an output shaft 786. At least a portion of the output shaft 786 is a female threaded rod. The secondary gear 783 (a spur gear) is rotationally coupled to the base 702, and accordingly the female threaded rod of the output shaft 786 rotates in response to an input torque on the drive input 785. A male threaded rod 782 is coupled to a foot/slider 781. In response to the respective rotation of the female threaded rod of the output shaft 786, which is threaded about the male threaded rod 782, the male threaded rod retracts or extends the foot/slider 781 relative to the base 702.

Importantly, due to the horizontal orientation of the drive input 785, a user may access and manipulate the retractable foot/slider assembly 780 single-handed and without requiring that the furniture be lifted to facilitate adjustment of the assembly (as is common with prior art furniture legs).

In some embodiments of the present disclosure, the foot/slider 781 may be replaced with a castor wheel. In such an embodiment a piece of furniture, equipment or other object to which occasional movement is desirable, may regularly sit on a base 702 of the assembly 780 for optimal stability; however, when relocation of the item is desirable, castor wheels 781 may be extended from a cavity of the base 702 so that the weight of the item is transferred from the bottom of the base 702 to the castor wheels 781—thereby facilitating easy relocation of the item.

With further respect to FIG. 7, the gearing ratio between the worm gear 784 and secondary gear 783 may be adjusted to improve mechanical advantage for heavier items being supported by the assembly 780 (thereby improving ease of use), or reducing the mechanical advantage to facilitate expedited extension/retraction of the foot/slider/castor wheel 781.

Depending on the application, the drive input 785 may facilitate hand adjustment (via a handle), receive a Philips or flat-head screw driver, or in more industrial applications receive a standard sized socket wrench. In yet more specific embodiments, the drive input may be coupled to a (servo-) motor communicatively coupled with controller circuitry of a chair consistent with the present disclosure. In such an embodiment, a user may initiate extending/retracting of the feet/sliders 781 via a controller to facilitate cleaning under the chair, re-positioning, leveling, etc. When used in conjunction with one or more on-board tilt sensors, controller circuitry of the chair may automatically adjust the respective feet/sliders to achieve a perfect level.

In some specific embodiments of the retractable foot/slider assembly 780, the primary and secondary gears are both bevel gears.

As discussed throughout the present disclosure, chair controller circuitry in response to a user input may implement various mechanisms of the chair to facilitate various exercises and stretches. In addition, the controller circuitry may utilize a speaker and/or display to verbally/visually communicate exercise/stretch instructions or to communicate upcoming actions. In addition, controller circuitry may facilitate voice activation of various functions.

As various applications of a chair in accordance with the present disclosure include users at high-risk for falls. Various safety feature may be implemented to reduce the risk or injury associate with the chair's use. For example, and as discussed in more detail above, a seatbelt (also referred to as a gait belt) may be utilized. In some more specific embodiments, two or more gait belts, a 3-point harness, or a 5-point harness may be utilized to further secure users with enhanced muscle weakness. In some specific embodiments, one or more ends of the belts and/or harnesses may be coupled to the chair structure via a force/pressure sensor. In response to excess force being exerted on the force/pressure sensor when the chair is in a standing configuration during an exercise/stretch (e.g., indicative of a user losing their footing and hanging from the belt/harness), the controller circuitry may automatically return the chair to an up-right seated configuration to allow the user to rest and regain their footing before proceeding.

In addition, the chair may include one or more panic buttons (such as near the base of the chair). When a user is in distress, such as after a fall, a user is more likely to reach a panic button in proximity to the floor.

The chair may also utilize one or more sensors to detect user presence. For example, a pressure/force sensor may be positioned between a seat support structure and a seat of the chair. When in use, in the up-right seated configuration, a sudden absence of a signal from the pressure/force sensor indicative of the user's presence may indicate a fall and trigger an audible/visual alarm for third-person intervention. In more specific embodiments, chair controller circuitry may be communicatively coupled to emergency services to facilitate alerting medical personality that a fall may have occurred.

Although several embodiments have been described above with a certain degree of particularity, those skilled in the art could make numerous alterations to the disclosed embodiments without departing from the spirit of the present disclosure. It is intended that all matter contained in the above description or shown in the accompanying drawings shall be interpreted as illustrative only and not limiting. Changes in detail or structure may be made without departing from the present teachings. The foregoing description and following claims are intended to cover all such modifications and variations.

Various embodiments are described herein of various apparatuses, systems, and methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," "an embodiment," or the like, means that a particular feature, structure, or characteristic described in connection with the embodiment is included in at least one embodiment. Thus, appearances of the phrases "in various embodiments," "in some embodiments," "in one embodiment," "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Various modules or other circuits may be implemented to carry out one or more of the operations and activities described herein and/or shown in the figures. In these contexts, a "module" is a circuit that carries out one or more of these or related operations/activities (e.g., chair controller circuitry). For example, in certain of the above-discussed embodiments, one or more modules are discrete logic circuits or programmable logic circuits configured and arranged for implementing these operations/activities. In certain embodiments, such a programmable circuit is one or more computer circuits programmed to execute a set (or sets) of instructions (and/or configuration data). The instructions (and/or configuration data) can be in the form of firmware or software stored in and accessible from a memory (circuit). As an example, first and second modules include a combination of a CPU hardware-based circuit and a set of instructions in the form of firmware, where the first module includes a first CPU hardware circuit with one set of instructions and the second module includes a second CPU hardware circuit with another set of instructions.

Certain embodiments are directed to a computer program product (e.g., nonvolatile memory device), which includes a machine or computer-readable medium having stored thereon instructions which may be executed by a computer (or other electronic device) to perform these operations/activities.

What is claimed is:

1. An adjustable chair comprising:

a backrest including a back support structure;

a seat including a seat support structure;

a base including a base mount; and a yaw mechanism coupled between the back support structure and the seat support structure, and configured and arranged to adjust a yaw of the backrest relative to the seat.

2. The adjustable chair of claim 1, wherein the yaw mechanism includes a yaw limiting mechanism configured and arranged to mechanically limit the angle of yaw the yaw mechanism may induce between the seat support structure and the back support structure.

3. The adjustable chair of claim 1, further including a roll mechanism, and a backrest mount that is coupled to the back support structure via the roll mechanism, the roll mechanism is configured and arranged to roll the backrest mount relative to the back support structure.

4. The adjustable chair of claim 3, wherein the roll mechanism includes a rack and pinion, the rack is coupled to the back support structure and the pinion is coupled to the backrest mount; and the roll mechanism is further configured and arranged in response to an electrical signal from controller circuitry to cause linear motion of the rack which induces rotation of the pinion and thereby the backrest mount.

5. The adjustable chair of claim 1, further including a lifting mechanism coupling the base mount and the seat support structure, and configured and arranged to adjust a pitch of the seat support structure;

a reclining mechanism coupling the seat support structure and the back support structure, and configured and arranged to adjust an attitude of the back support structure relative to the seat support structure; and a leg rest rotatably coupled to a base mount, and a leg rest mechanism configured and arranged to rotate the leg rest relative to the base mount;

wherein the leg rest mechanism is independently operable relative to the lifting mechanism and the reclining mechanism and the leg rest mechanism and the lifting mechanism share a common hinge point.

6. The adjustable chair of claim 5, further including controller circuitry communicatively coupled to the lifting mechanism and the reclining mechanism, the controller circuitry configured and arranged to independently operate the lifting mechanism and the reclining mechanism relative to one another.

7. The adjustable chair of claim 5, wherein the lifting mechanism includes one or more linear actuators, a first hinge point rotatably coupling the base mount to the seat support structure, a second hinge point rotatably coupling the one or more linear actuators to the seat support structure, and a third hinge point rotatably coupling the one or more linear actuators to the base mount; and wherein the one or more linear actuators are configured and arranged to extend/retract in response to an electrical signal from controller circuitry communicatively coupled thereto, and effect the pitch of the seat support structure relative to the base mount.

8. The adjustable chair of claim 5, wherein the lifting mechanism includes a first hinge point rotatably coupling the base mount to the seat support structure, a motor coupled to the base mount and rotatably coupled to the seat support structure at the first hinge point, the motor configured and arranged in response to an electrical signal from controller circuitry communicatively coupled thereto to effect a torque on the seat support structure relative to the base mount that effects the pitch of the seat support structure relative to the base mount.

9. The adjustable chair of claim 1, further including a primary pair of armrests mounted to the base, and an auxiliary pair of armrests mounted to a backrest.

10. The adjustable chair of claim 9, further including a seat belt removably coupled to each of the auxiliary armrests.

11. A method of operating an adjustable chair including the steps of:

receiving a user input indicative of a desired assisted exercise and/or stretch; and activating one or more of a plurality of mechanisms within the adjustable chair to facilitate the assisted exercise and/or stretch of the user;

wherein the plurality of mechanisms includes a yaw mechanism, and the desired assisted exercise and/or stretch induces a yaw in a backrest of the adjustable chair via the yaw mechanism.

12. The method of claim 11, wherein the desired assisted exercise and/or stretch is one or more torso twists.

13. The method of claim 11, wherein the plurality of mechanisms further includes a roll mechanism, and the desired assisted exercise and/or stretch requires activating of the roll mechanism; and wherein the step of activating one or more of the plurality of mechanisms includes activating of the roll mechanism to induce a roll in a backrest of the adjustable chair.

14. The method of claim 13, wherein the desired assisted exercise and/or stretch is one or more lateral flexions.

15. The method of claim 11, further including the steps of:

securing the user to the adjustable chair;

selecting the desired assisted exercise and/or stretch on a user interface; and returning the adjustable chair to a start position at the end of the assisted exercise and/or stretch.

16. The method of claim 11, wherein the step of activating one or more of a plurality of mechanisms within the adjustable chair to facilitate the assisted exercise and/or stretch of the user includes simultaneous operation of two or more of the plurality of the mechanisms.

17. An adjustable chair comprising:

a backrest including a back support structure and a backrest mount rotatably coupled to the back support structure;

a seat including a seat support structure;

a base including a base mount; and a roll mechanism is configured and arranged to roll the backrest mount relative to the back support structure.

18. The adjustable chair of claim 17, wherein the roll mechanism includes a rack and pinion, the rack is coupled to the back support structure and the pinion is coupled to the backrest mount; and the roll mechanism is configured and arranged in response to an electrical signal from controller circuitry to cause linear motion of the rack which induces rotation of the pinion and thereby the backrest mount.

19. An adjustable chair comprising:

a backrest including a back support structure;

a seat including a seat support structure;

a base including a base mount;

a lifting mechanism coupling the base mount and the seat support structure, and configured and arranged to adjust a pitch of the seat support structure;

wherein the lifting mechanism includes a first hinge point rotatably coupling the base mount to the seat support structure, and a motor coupled to the base mount and rotatably coupled to the seat support structure at the first hinge point, the motor configured and arranged in response to an electrical signal from controller circuitry communicatively coupled thereto to effect a torque on the seat support structure relative to the base mount that effects the pitch of the seat support structure relative to the base mount.

20. An adjustable chair comprising:

a backrest;

a base;

a seat coupled between the base and the backrest;

a primary pair of armrests mounted to the base, and an auxiliary pair of armrests mounted to a backrest.

21. A method of operating an adjustable chair including the steps of:

receiving a user input indicative of a desired assisted exercise and/or stretch; and activating one or more of a plurality of mechanisms within the adjustable chair to facilitate the assisted exercise and/or stretch of the user;

wherein the plurality of mechanisms includes a roll mechanism, and the desired assisted exercise and/or stretch induces a roll in the backrest of the adjustable chair via the roll mechanism.

22. The method of claim 21, wherein the desired assisted exercise and/or stretch is one or more lateral flexions.

* * * * *